United States Patent [19]

Maskasky

[11] Patent Number: 4,680,254

[45] Date of Patent: Jul. 14, 1987

[54] EMULSIONS AND PHOTOGRAPHIC ELEMENTS CONTAINING SILVER HALIDE GRAINS HAVING HEXOCTAMEDRAL CRYSTAL FACES

[75] Inventor: Joe E. Maskasky, Rochester, N.Y.

[73] Assignee: Eastman Kodak Company, Rochester, N.Y.

[21] Appl. No.: 881,768

[22] Filed: Jul. 3, 1986

Related U.S. Application Data

[63] Continuation-in-part of Ser. No. 771,861, Sep. 3, 1985, abandoned.

[51] Int. Cl.[4] ..... G03C 1/02

[52] U.S. Cl. ..... 430/567; 423/489; 423/491

[58] Field of Search ..... 430/567; 423/489, 491

[56] References Cited

U.S. PATENT DOCUMENTS

| | | | |
|---|---|---|---|
| 1,696,830 | 12/1928 | Wulff et al. | 430/ |
| 3,519,426 | 7/1970 | Halwig | 96/94 |
| 3,885,970 | 5/1975 | Miyahara | 430/567 |
| 4,094,684 | 6/1978 | Maskasky | 430/567 |
| 4,142,900 | 3/1979 | Maskasky | 430/567 |
| 4,183,756 | 1/1980 | Locker | 430/569 |
| 4,184,878 | 1/1980 | Maternaghan | 430/567 |
| 4,225,666 | 9/1980 | Locker et al. | 430/569 |
| 4,339,532 | 7/1982 | Corben et al. | 430/567 |
| 4,386,156 | 5/1983 | Mignot | 430/567 |
| 4,400,463 | 8/1983 | Maskasky | 430/564 |
| 4,463,087 | 7/1984 | Maskasky | 430/567 |

FOREIGN PATENT DOCUMENTS 58-54333 3/1983 Japan .

OTHER PUBLICATIONS

J. E. Maskasky, "An Enhanced Understanding of Silver Halide Tabular-Grain Growth", Journal of Imaging Science, vol. 31, No. 1, Jan.-Feb. 1987.

James, *The Theory of the Photographic Process*, 4th Ed., Macmillan, New York, 1977, pp. 98 through 100.

Berry, "Surface Structure and Reactivity of AgBr Dodecahedra", *Photographic Science and Engineering*, vol. 19, No. 3, May/Jun. 1975, pp. 171 and 172.

Klein et al, "Formation of Twins of AgBr and AgCl Crystals in Photographic Emulsions", *Photographische Korrespondenz*, vol. 99, No. 7, pp. 99-102 (1963).

A. P. H. Trivelli and S. E. Sheppard, *The Silver Bromide Grain of Photographic Emulsions*, Van Nostrand, Chapters VI and VIII, 1921.

W. Reinders, "Studies of Photohalide Crystals", *Kolloid-Zeitschrift*, vol. 9, pp. 10-14 (1911).

W. Reinders, "Study of Photohalides III Absorption of Dyes, Proteins and Other Organic Compounds in Crystalline Silver Chloride", *Zeitschrift fur Physikalische Chemie*, vol. 77, pp. 677-699 (1911).

Hirata et al, "Crystal Habit of Photographic Emulsion Grains", *J. Photog. Soc. of Japan*, vol. 36, pp. 359-363 (1973).

Oppenheimer et al, "Role of Cationic Surfactants in Recrystallization of Aqueous Silver Bromide Dispersions" in *Particle Growth and Suspension*, A. L. Smith ed., Academic Press, London, 1973, pp. 159-178.

Ralph W. G. Wyckoff, *Crystal Structures*, 2nd Ed., vol. 1, Interscience Publishers, 1963.

Ernest E. Wahlstrom, *Optical Crystallography*, 5th Ed., John Wiley and Sons, 1979.

Deer, Howie, and Zussman, *An Introduction to the Rock-Forming Minerals*, Longmans Green and Co. Ltd., 1967.

Joseph V. Smith, *Geometrical and Structural Crystallography*, John Wiley and Sons, 1982.

Cornelius Hurburt, Jr., *Dana's Manual of Mineralogy*, John Wiley and Sons, Inc., 18th Ed., 1971, pp. 44 and 48.

*Primary Examiner*—John E. Kittle
*Assistant Examiner*—Mukund J. Shah
*Attorney, Agent, or Firm*—Carl O. Thomas

[57] ABSTRACT

Silver halide photographic emulsions are disclosed comprised of radiation sensitive silver halide grains of a cubic crystal lattice structure comprised of hexoctahedral crystal faces.

11 Claims, 15 Drawing Figures

1 μm

1 μm

1μm

1μm

EMULSIONS AND PHOTOGRAPHIC ELEMENTS CONTAINING SILVER HALIDE GRAINS HAVING HEXOCTAMEDRAL CRYSTAL FACES

This application is a continuation-in-part of copending U.S. Ser. No. 771,861, filed Sept. 3, 1985, now abandoned commonly assigned.

FIELD OF THE INVENTION

This invention relates to photography. More specifically, this invention is directed to photographic emulsions containing silver halide grains and to photographic elements containing these emulsions.

BACKGROUND OF THE INVENTION

Silver halide photography has been practiced for more than a century. The radiation sensitive silver halide compositions initially employed for imaging were termed emulsions, since it was not originally appreciated that a solid phase was present. The term "photographic emulsion" has remained in use, although it has long been known that the radiation sensitive component is present in the form of dispersed microcrystals, typically referred to as grains.

Over the years silver halide grains have been the subject of intense investigation. Although high iodide silver halide grains, those containing at least 90 mole percent iodide, based on silver, are known and have been suggested for photographic applications, in practice photographic emulsions almost always contain silver halide grains comprised of bromide, chloride, or mixtures of chloride and bromide optionally containing minor amounts of iodide. Up to about 40 percent iodide, based on silver, can be accommodated in a silver bromide crystal structure without observation of a separate silver iodide phase. However, in practice silver halide emulsions rarely contain more than about 15 mole percent iodide, with iodide well below 10 mole percent being most common.

All silver halide grains, except high iodide silver halide grains, exhibit cubic crystal lattice structures. However, grains of cubic crystal lattice structures can differ markedly in appearance.

In one form silver halide grains when microscopically observed are cubic in appearance. A cubic grain 1 is shown in FIG. 1. The cubic grain is bounded by six identical crystal faces. In the photographic literature these crystal faces are usually referred to as {100} crystal faces, referring to the Miller index employed for designating crystal faces. While the {100} crystal face designation is most commonly employed in connection with silver halide grains, thee same crystal faces are sometimes also referred to as {200} crystal faces, the difference in designation resulting from a difference in the definition of the basic unit of the crystal structure. Although the cubic crystal shape is readily visually identified in regular grains, in irregular grains cubic crystal faces are not always square. In grains of more complex shapes the presence of cubic crystal faces can be verified by a combination of visual inspection and the 90° angle of intersection formed by adjacent cubic crystal faces.

The practical importance of the {100} crystal faces is that they present a unique surface arrangement of silver and halide ions, which in turn influences the grain surface reactions and adsorptions typically encountered in photographic applications. This unique surface arrangement of ions as theoretically hypothesized is schematically illustrated in FIG. 2, wherein the smaller spheres 2 represent silver ions while the larger spheres 3 designate bromine ions. Although on an enlarged scale, the relative size and position of the silver and bromide ions is accurately represented. When chloride ions are substituted for bromide ions, the relative arrangement would remain the same, although the chloride ions are smaller than the bromide ions. It can be seen that a plurality of parallel rows, indicated by lines 4, are present, each formed by alternating silver and bromine ions. In FIG. 2 a portion of the next tier of ions lying below the surface tier is shown to illustrate their relationship to the surface tier of ions.

In another form silver halide grains when microscopically observed are octahedral in appearance. An octahedral grains 5 is shown in FIG. 3. The octahedral grain is bounded by eight identical crystal faces. These crystal faces are referred to as {111} crystal faces. Although the octahedral crystal shape is readily visually identified in regular grains, in irregular grains octahedral crystal faces are not always triangular. In grains of more complex shapes the presence of octahedral crystal faces can be verified by a combination of visual inspection and the 109.5° angle of intersection formed by adjacent octahedral crystal faces.

Ignoring possible ion adsorptions, octahedral crystal faces differ from cubic crystal faces in that the surface tier of ions can be theoretically hypothesized to consist entirely of silver ions or halide ions. FIG. 4 is a schematic illustration of a {111} crystal face, analogous to FIG. 2, wherein the smaller spheres 2 represent silver ions while the larger spheres 3 designate bromine ions. Although silver ions are shown at the surface in every available lattice position, it has been suggested that having silver ions in only every other available lattice position in the surface tier of atoms would be more compatible with surface charge neutrality. Instead of a surface tier of silver ions, the surface tier of ions could alternatively be bromide ions. The tier of ions immediately below the surface silver ions consists of bromide ions.

In comparing FIGS. 1 and 2 with FIGS. 3 and 4 it is important to bear in mind that both the cubic and octahedral grains have exactly the same cubic crystal lattice structure and thus exactly the same internal relationship of silver and halide ions. The two grains differ only in their surface crystal faces. Note that in the cubic crystal face of FIG. 2 each surface silver ion lies immediately adjacent five halide ions, whereas in FIG. 4 the silver ions at the octahedral crystal faces each lie immediately adjacent only three halide ions.

Much less common than either cubic or octahedral silver halide grains are rhombic dodecahedral silver halide grains. A rhombic dodecahedral grain 7 is shown in FIG. 5. The rhombic dodecahedral grain is bounded by twelve identical crystal faces. These crystal faces are referred to as {110} (or, less commonly in reference to silver halide grains, {220}) crystal faces. Although the rhombic dodecahedral crystal shape is readily visually identified in regular grains, in irregular grains rhombic dodecahedral crystal faces can vary in shape. In grains of more complex shapes the presence of rhombic dodecahedral crystal faces can be verified by a combination of visual inspection and measurement of the angle of intersection formed by adjacent crystal faces.

Rhombic dodecahedral crystal faces can be theoretically hypothesized to consist of alternate rows of silver ions and halide ions. FIG. 6 is a schematic illustration analogous to FIGS. 2 and 4, wherein it can be seen that the surface tier of ions is formed by repeating pairs of silver and bromide ion parallel rows, indicated by lines 8*a* and 8*b*, respectively. In FIG. 6 a portion of the next tier of ions lying below the surface tier is shown to illustrate their relationship to the surface tier of ions. Note that each surface silver ion lies immediately adjacent four halide ions.

Although photographic silver halide emulsions containing cubic crystal lattice structure grains are known which contain only regular cubic grains, such as the grain shown in FIG. 1, regular octahedral grains, such as the grain shown in FIG. 3, or, in rare instances, regular rhombic dodecahedral grains, such as the grain shown in FIG. 5, in practice many other varied grain shapes are also observed. For example, silver halide grains can be cubo-octahedral-that is, formed of a combination of cubic and octahedral crystal faces. This is illustrated in FIG. 7, wherein cubo-octahedral grains 9 and 10 are shown along with cubic grain 1 and octahedral grain 5. The cubo-octahedral grains have fourteen crystal faces, six cubic crystal faces and eight octahedral crystal faces. Analogous combinations of cubic and/or octahedral crystal faces and rhombic dodecahedral crystal faces are possible, though rarely encountered. Other grain shapes, such as tabular grains and rods, can be attributed to internal crystal irregularities, such as twin planes and screw dislocations. In most instances some corner or edge rounding due to solvent action is observed, and in some instances rounding is so pronounced that the grains are described as spherical.

It is known that for cubic crystal lattice structures crystal faces can take any one of seven possible distinct crystallographic forms. However, for cubic crystal lattice structure silver halides only grains having {100} (cubic), {111} (octahedral), or, rarely, {110} (rhombic dodecahedral) crystal faces, individually or in combination, have been identified.

It is thus apparent that the photographic art has been limited in the crystal faces presented by silver halide grains of cubic crystal lattice structure. As a result the art has been limited in modifying photographic properties to the choice of surface sensitizers and adsorbed addenda that are workable with available crystal faces, in most instances cubic and octahedral crystal faces. This has placed restrictions on the combinations of materials that can be employed for optimum photographic performance or dictated accepting less than optimum performance.

Relevant Art

Silver halide emulsions having faces of the tetrahexahedral, trisoctahedral, or icositetrahedral crystallographic form are separately the subject matter of commonly assigned U.S. Ser. Nos. 772,228, 772,229, and 772,271, each filed Sept. 3, 1985, titled *SILVER HALIDE PHOTOGRAPHIC EMULSIONS WITH NOVEL GRAIN FACES* (2), (3), or (4), respectively.

Silver halide emulsions having ruffled grain faces presenting crystal faces of varied crystallographic forms, including the hexoctahedral form, are the subject of commonly assigned U.S. Ser. No. 772,271, filed Sept. 3, 1985, titled *SILVER HALIDE PHOTOGRAPHIC EMULSIONS WITH NOVEL GRAIN FACES* (5).

F. C. Phillips, *An Introduction to Crystallography,* 4th Ed., John Wiley & Sons, 1971, is relied upon as authority for the basic precepts and terminology of crystallography herein presented.

James, *The Theory of the Photographic Process,* 4th Ed., Macmillan, New York, 1977, pp. 98 through 100, is corroborative of the background of the invention described above. In addition, James at page 98 in reference to silver halide grains states that high Miller index faces are not found.

Berry, "Surface Structure and Reactivity of AgBr Dodecahedra", *Photographic Science and Engineering,* Vol. 19, No. 3, May/June 1975, pp. 171 and 172, illustrates silver bromide emulsions containing {110} crystal faces.

Klein et al, "Formation of Twins of AgBr and AgCl Crystals in Photographic Emulsions", *Photographische Korrespondenz,* Vol. 99, No. 7, pp. 99–102 (1963) describes a variety of singly and doubly twinned silver halide crystals having {100} (cubic) and {111} (octahedral) crystal faces. Klein et al is of interest in illustrating the variety of shapes which twinned silver halide grains can assume while still exhibiting only {111} or {100} crystal faces.

A. P. H. Trivelli and S. E. Sheppard, *The Silver Bromide Grain of Photographic Emulsions,* Van Nostrand, Chapters VI and VIII, 1921, is cited for historical interest. Magnifications of 2500× and lower temper the value of these observations. Much higher resolutions of grain features are obtainable with modern electron microscopy.

W. Reinders, "Studies of Photohalide Crystals", *Kolloid-Zeitschrift,* Vol. 9, pp. 10–14 (1911); W. Reinders, "Study of Photohalides III Absorption of Dyes, Proteins and Other Organic Compounds in Crystalline Silver Chloride", *Zeitschrift fur Physikalische* Chemie, Vol. 77, pp. 677–699 (1911); Hirata et al, "Crystal Habit of Photographic Emulsion Grains", J. *Photog. Soc. of Japan,* Vol. 36, pp. 359–363 (1973); Locker U.S. Pat. No. 4,183,756; and Locker et al U.S. Pat. No. 4,225,666 illustrate teachings of modifying silver halide grain shapes through the presence of various materials present during silver halide grain formation.

Wulff et al U.S. Pat. No. 1,696,830 and Heki et al Japanese Kokai 58[1983]-54333 describe the precipitation of silver halide in the presence of benzimidazole compounds.

Halwig U.S. Pat. No. 3,519,426 and Oppenheimer et al, "Role of Cationic Surfactants in Recrystallization of Aqueous Silver Bromide Dispersions", Smith *Particle Growth and Suspension,* Academic Press, London, 1973, pp. 159–178, disclose additions of 4-hydroxy-6-methyl-1,3,3a,7-tetraazaindene to silver chloride and silver bromide emulsions, respectively.

In addition to the foregoing art the Examiner has placed of record in parent U.S. Ser. No. 771,861, referenced above, the following art:

Maskasky U.S. Pat. No. 4,463,087;
Maskasky U.S. Pat. No. 4,400,463;
Mignot U.S. Pat. No. 4,386,156;
Corben et al U.S. Pat. No. 4,339,532;
Maternaghan U.S. Pat. No. 4,094,684;
Maternaghan U.S. Pat. No. 4,142,900;
Miyahara U.S. Pat. No. 3,885,970;
Ralph W. G. Wyckoff, *Crystal Structures,* 2nd Ed., Vol. 1, Interscience Publishers, 1963;
Ernest E. Wahlstrom, *Optical Crystallography,* 5th Ed., John Wiley and Sons, 1979;

Deer, Howie, and Zussman, An Introduction to the Rock-Forming Minerals, Longmans Green and Co. Ltd., 1967;

Joseph V. Smith, Geometrical and Structural Crystallography, John Wiley and Sons, 1982; and Cornelius Hurburt, Jr., *Dana's Manual of Mineralogy*, John Wiley and Sons, Inc., 18th Ed., 1971, pp. 44 and 48.

SUMMARY OF THE INVENTION

In one aspect this invention is directed to a silver halide photographic emulsion comprised of radiation sensitive silver halide grains of a cubic crystal lattice structure comprised of hexoctahedral crystal faces.

In another aspect this invention is directed to a photographic element containing at least one emulsion of the type previously described.

The invention presents to the art for the first time the opportunity to realize the unique surface configuration of hexoctahedral crystal faces in photographic silver halide emulsions. The invention thereby renders accessible for the first time a new choice of crystal faces for modifying photographic characteristics and improving interactions with sensitizers and adsorbed photographic addenda.

DESCRIPTION OF PREFERRED EMBODIMENTS

The present invention relates to silver halide photographic emulsions comprised of radiation sensitive silver halide grains of a cubic crystal lattice structure comprised of hexoctahedral crystal faces and to photographic elements including the emulsions.

Figure 8:
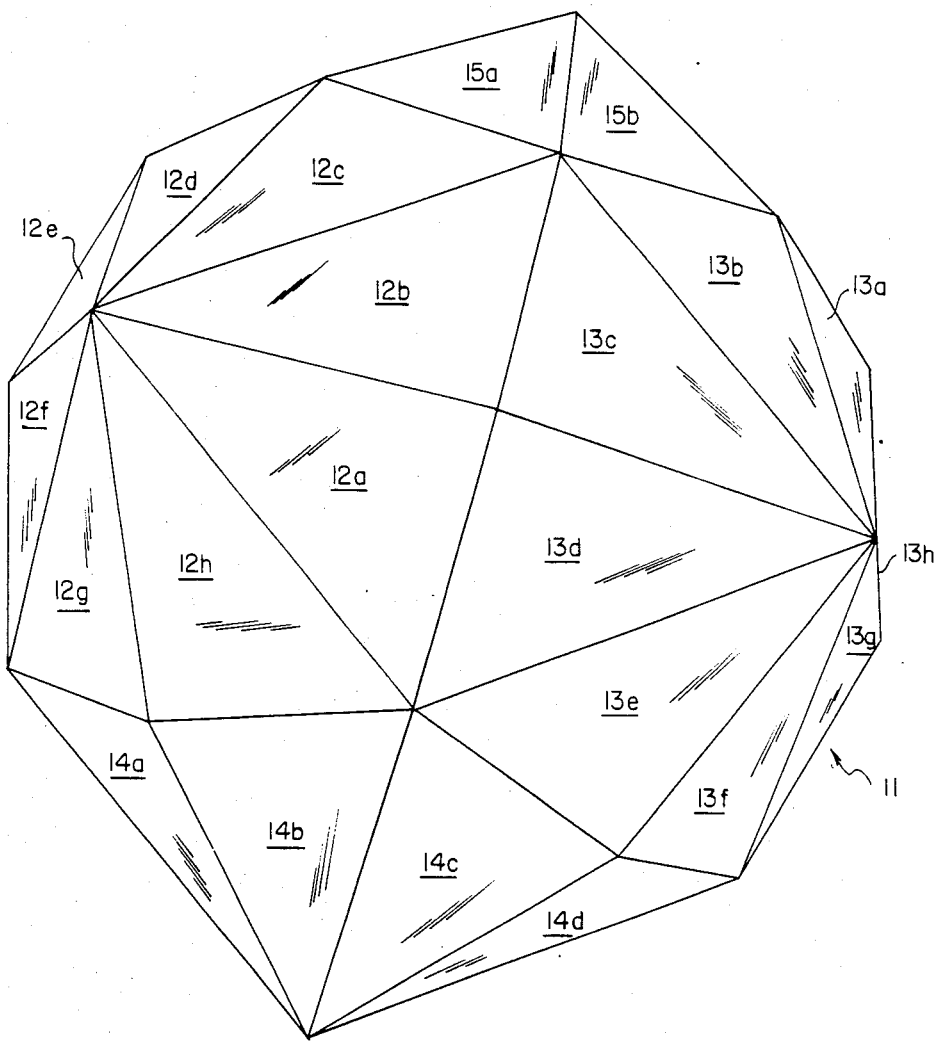
FIGS. 8 and 9 are front and rear isometric views of a regular {321} hexoctahedron.
Figure 9:
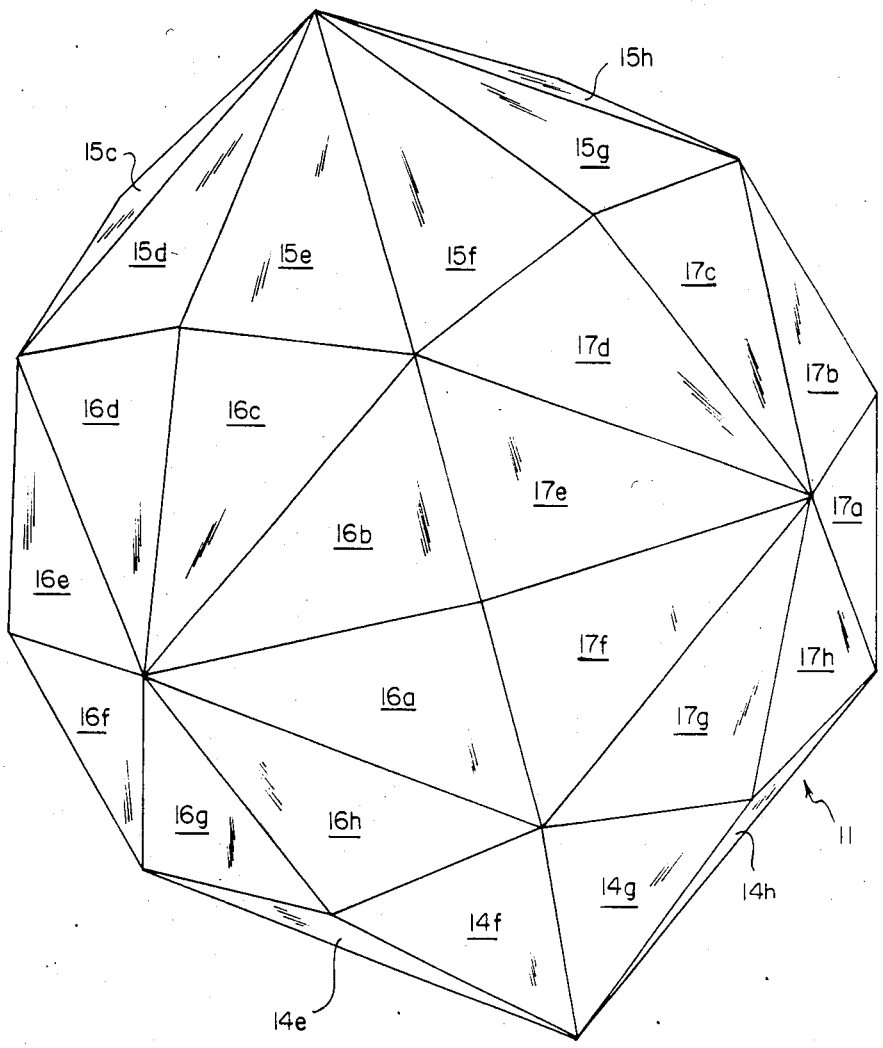

In one form the silver halide grains can take the form of regular hexoctahedra. A regular hexoctahedron 11 is shown in FIGS. 8 and 9. A hexoctahedron has forty-eight identical faces. although any grouping of faces is entirely arbitrary, the hexoctahedron can be visualized as six separate clusters of crystal faces, each cluster containing eight separate faces. In FIG. 8 faces 12*a*, 12*b*, 12*c*, 12*d*, 12*e*, 12*f*, 12*g*, and 12*h* can be visualized as members of a first cluster of faces. A second cluster of faces is represented by faces 13*a*, 13*b*, 13*c*, 13*d*, 13*e*, 13*f*, and 13*g*. The eighth face of the cluster, 13*h*, is shown substantially normal to the field of view. Faces 14*a*, 14*b*, 14*c*, and 14*d* represent four visible faces of a third cluster of eight faces, and faces 15*a* and 15*b* represent two visible faces of a fourth cluster of eight faces. Two remaining clusters of eight faces each are entirely hidden from view on the opposite side of the hexoctahedron.

FIG. 9 shows a back view of the hexoctahedron 11 obtained by 180° rotation of the hexoctahedron about a vertical axis. Faces 14*e*, 14*f*, 14*g*, and 14*h* of the third cluster are shown. Faces 15*c*, 15*d*, 15*e*, 15*f*, 15*g*, and 15*h* of the fourth cluster are shown. Faces 16*a*, 16*b*, 16*c*, 16*d*, 16*e*, 16*f*, 16*g*, and 16*h* forming a fifth cluster are shown. Faces 17*a*, 17*b*, 17*c*, 17*d*, 17*e*, 17*f*, 17*g*, and 17*h* complete the sixth cluster.

Looking at the hexoctahedron it can be seen that there are eight intersections of adjacent faces within each cluster, and there are two face intersections of each cluster with each of the four clusters adjacent to it for a total of seventy-two face edge intersections. The relative angles formed by intersecting faces have only three different values. All intersections of a face from one cluster with a face from another cluster are identical, forming a first relative angle. All adjacent faces within each cluster intersect at one of two different relative angles. Looking at one cluster in which all faces are fully visible, the intersections between faces 12*a* and 12*b*, 12*c* and 12*d*, 12*e* and 12*f*, and 12*g* and 12*h* are all at the same relative angle, referred to as a second relative angle. The intersections between faces 12*b* and 12*c*, 12*d* and 12*e*, 12*f* and 12*g*, and 12*h* and 12*a* are all at the same relative angle, referred to as a third relative angle, since it is of a different value than both the first and second relative angles. While the regular hexoctahedron has a distinctive appearance that can be recognized by visual inspection, it should be appreciated that measurement of any one of the three relative angles provides a corroboration of adjacent hexoctahedral crystal faces.

In crystallography measurement of relative angles of adjacent crystal faces is employed for positive crystal face identification. Such techniques are described, for example, by Phillips, cited above. These techniques can be combined with techniques for the microscopic examination of silver halide grains to identify positively the hexoctahedral crystal faces of silver halide grains. Techniques for preparing electron micrographs of silver halide grains are generally well known in the art, as illustrated by B. M. Spinell and C. F. Oster, "Photographic Materials", *The Encyclopedia of Microscopy and Microtechnique*, P. Gray, ed., Van Nostrand, N.Y., 1973, pp. 427–434, note particularly the section dealing with carbon replica electron microscopy at pages 429 and 430. Employing techniques well known in electron microscopy, carbon replicas of silver halide grains are first prepared. The carbon replicas reproduce the grain shape while avoiding shape altering silver print-out that is known to result from employing the silver halide grains without carbon shells. An electron scanning beam rather than light is employed for imaging to permit higher ranges of magnification to be realized than when light is employed. When the grains are sufficiently spread apart that adjacent grains are not impinging, the grains lie flat on one crystal face rather than on a coign (i.e., a point). By tilting the sample being viewed relative to the electron beam a selected grain can be oriented so that the line of sight is substantially parallel to both the line of intersection of two adjacent crystal faces, seen as a point, and each of the two intersecting crystal faces, seen as edges. When the grain faces are parallel to the imaging electron beam, the two corresponding edges of the grain which they define will appear sharper than when the faces are merely close to being parallel. Once the desired grain orientation with two intersecting crystal faces presenting a parallel edge to the electron beam is obtained, the angle of intersection can be measured from an electron micrograph of the oriented grain. In this way adjacent hexoctahedral crystal faces can be identified. Relative angles of hexoctahedral and adjacent crystal faces of other Miller indices can also be determined in the same way. Again, the unique relative angle allows a positive identification of the crystal faces. While relative angle measurements can be definitive, in many, if not most, instances visual inspection of grains by electron microscopy allows immediate identification of hexoctahedral crystal faces.

Referring to the mutually perpendicular x, y, and z axes of a cubic crystal lattice, it is well recognized in the art that cubic crystal faces are parallel to two of the axes and intersect the third, thus the {100} Miller index assignment; octahedral crystal faces intersect each of the three axes at an equal interval, thus the {111} Miller index assignment; and rhombic dodecahedral crystal faces intersect two of the three axes at an equal interval and are parallel to the third axis, thus the {110} Miller index assignment. For a given definition of the basic crystal unit, there is one and only one Miller index assignment for each of cubic, octahedral, and rhombic dodecahedral crystal faces.

Hexoctahedral crystal faces include a family of crystal faces that can have differing Miller index values. Hexoctahedral crystal faces are generically designated as {hkl crystal faces, wherein h, k, and l are each integers greater than 0; h is greater than k; and k is greater than l. The regular hexoctahedron 11 shown in FIGS. 8 and 9 consists of {321} crystal faces, which corresponds to the lowest value that h, k, and l can each represent. A regular hexoctahedron having {421}, {431}, {432}, {521}, {531}, {532}, {541}, {542}, or {543} crystal faces would appear similar to the hexotahedron 11, but the higher Miller indices would result in changes in the angles of intersection. Although there is no theoretical limit on the maximum values of the integers h, k, and l, hexoctahedral crystal faces having a value of h of 5 or less are more easily generated. For this reason, silver halide grains having hexoctahedral crystal faces of the exemplary Miller index values identified above are preferred. With practice one hexoctahedral crystal face can often be distinguished visually from another of a different Miller index value. Measurement of relative angles permits positive corroboration of the specific Miller index value hexoctahedral crystal faces present.

In one form the emulsions of this invention contain silver halide grains which are bounded entirely by hexoctahedral crystal faces, thereby forming basically regular hexoctahedra. In practice although some edge rounding of the grains is usually present, the unrounded residual flat hexoctahedral faces permit positive identification, since a sharp intersecting edge is unnecessary to establishing the relative angle of adjacent hexoctahedral crystal faces. Sighting to orient the grains is still possible employing the residual flat crystal face portions.

The radiation sensitive silver halide grains present in the emulsions of this invention are not confined to those in which the hexoctahedral crystal faces are the only flat crystal faces present. Just as cubo-octahedral silver halide grains, such as 9 and 10, exhibit both cubic and octahedral crystal faces and Berry, cited above, reports grains having cubic, octahedral, and rhombic dodecahedral crystal faces in a single grain, the radiation sensitive grains herein contemplated can be formed by hexoctahedral crystal faces in combination with any one or combination of the other types of crystal faces possible with a silver halide cubic crystal lattice structure. For example, if conventional silver halide grains having cubic, octahedral, and/or rhombic dodecahedral crystal faces are employed as host grains for the preparation of silver halide grains having hexoctahedral crystal faces, stopping silver halide deposition onto the host grains before the original crystal faces have been entirely overgrown by silver halide under conditions favoring hexoctahedral crystal face formation results in both hexoctahedral crystal faces and residual crystal faces corresponding to those of the original host grain being present. Starting with cubic host grains, the preparation of cubo-hexoctahedral grains is illustrated in the examples.

In another variant form deposition of silver halide onto host grains under conditions which favor hexoctahedral crystal faces can initially result in ruffling of the grain surfaces. Under close examination it has been observed that the ruffles are provided by protrusions from the host grain surface. Protrusions in the form of ridges have been observed, but protrusions, when present, are more typically in the form of pyramids. Pyramids presenting hexoctahedral crystal faces on host grains initially presenting {100} crystal faces have eight surface faces. These correspond to the eight faces of any one of the 12, 13, 14, 15, 16, or 17 series clusters described above in connection with the hexoctahedron 11. When the host grains initially present {111} crystal faces, pyramids bounded by six surface faces are formed. Turning to FIG. 8, the apex of the pyramid corresponds to the coign formed faces 12*a*, 12*h*, 13*d*, 13*c*, 14*b*, and 14*c*. If the host grains initially present {110} crystal faces, pyramids bounded by four surface faces are formed. Turning to FIG. 8, the apex of the pyramid corresponds to the coign formed faces 12*a*, 12*b*, 13*c*, and 13*d*. The protrusions, whether in the form of ridges or pyramids, can within a short time of initiating precipitation onto the host grains substantially cover the original host grain surface. If silver halide deposition is continued after the entire grain surface is bounded by hexoctahedral crystal faces, the protrusions become progressively larger and eventually the grains lose their ruffled appearance as they present larger and larger hexoctahedral crystal faces. It is possible to grow a regular hexoctahedron from a ruffled grain by continuing silver halide deposition. Silver halide grains which have had their surface to volume ratios increased by ruffling are the specific subject matter of concurrently filed, commonly assigned Ser. No. 772,271, titled SILVER HALIDE PHOTOGRAPHIC EMULSIONS WITH NOVEL GRAIN FACES (5), cited above.

Even when the grains are not ruffled and bounded entirely by hexoctahedral crystal faces, the grains can take overall shapes differing from regular hexoctahedrons. This can result, for example, from irregularities, such as twin planes, present in the host grains prior to growth of the hexoctahedral crystal faces or introduced during growth of the hexoctahedral crystal faces.

Figure 1:
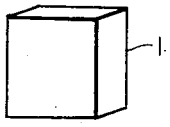
FIG. 1 is an isometric view of a regular cubic silver halide grain.
Figure 3:
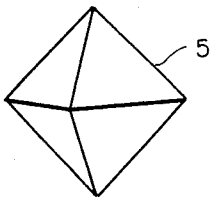
FIG. 3 is an isometric view of a regular octahedral silver halide grain.
Figure 2:
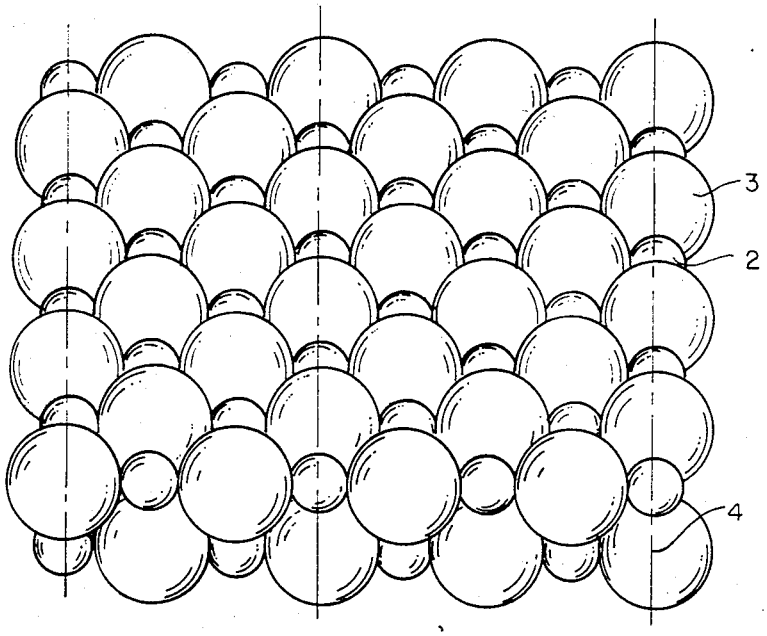
FIG. 2 is a schematic diagram of the atomic arrangement at a silver bromide cubic crystal surface.
Figure 4:
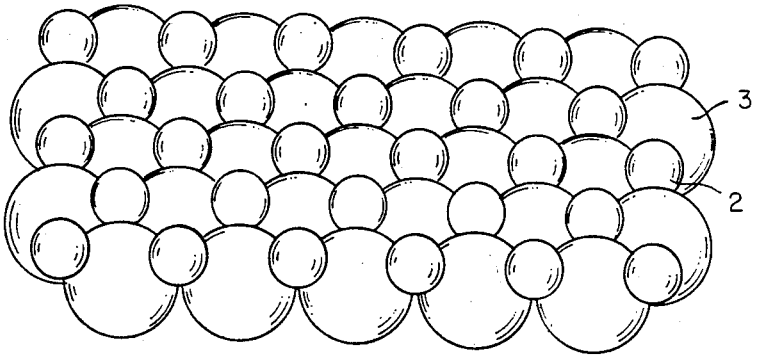
FIG. 4 is a schematic diagram of the atomic arrangement at a silver bromide octahedral crystal surface.
Figure 5:
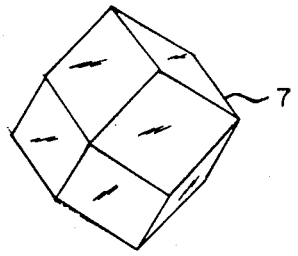
FIG. 5 is an isometric view of a regular rhombic dodecahedron.
Figure 6:
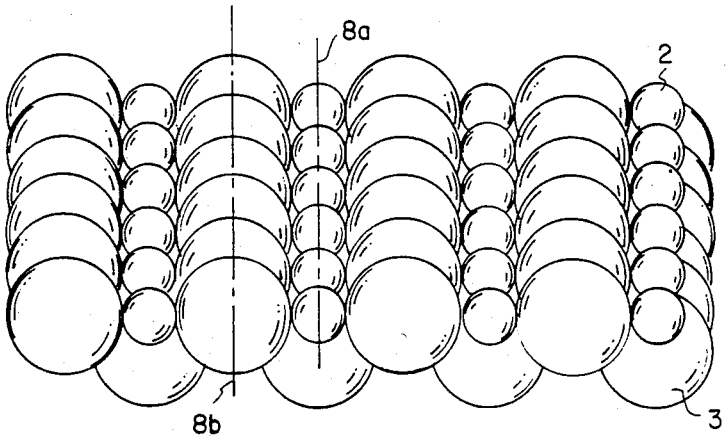
FIG. 6 is a schematic diagram of the atomic arrangement at a silver bromide rhombic dodecahedral crystal surface.
Figure 10:
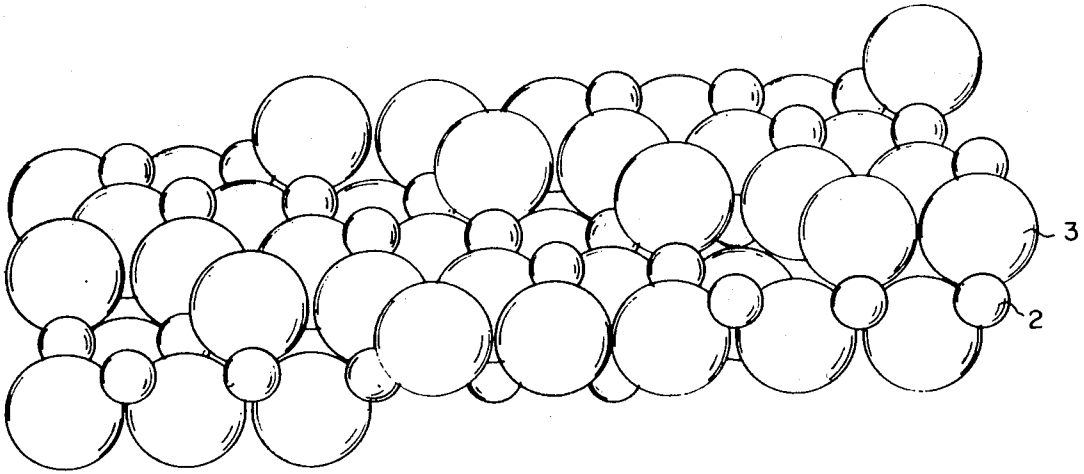
FIG. 10 is a schematic diagram of the atomic arrangement at a silver bromide {321} hexoctahedral crystal surface.

The important feature to note is that if any crystal faces of silver halide grain is a hexoctahedral crystal face, the resulting grain presents a unique arrangement of surface silver and halide ions that differs from that presented by all other possible crystal faces for cubic crystal lattice structure silver halides. This unique surface arrangement of ions as theoretically hypothesized is schematically illustrated by FIG. 10, wherein a {321} hexoctahedral crystal face is shown formed by silver ions 2 and bromide ions 3. Comparing FIG. 10 with FIGS. 2, 4, and 6, it is apparent that the surface positioning of silver and bromide ions in each figure is distinctive. The {321} hexoctahedral crystal face presents an ordered, but more varied arrangement of surface silver and bromide ions than is presented at the cubic, octahedral, or rhombic dodecahedral silver bromide crystal faces. This is a result of the oblique tiering that occurs at the {321} hexoctahedral crystal face. Hexoctahedral crystal faces with differing Miller indices also exhibit oblique tiering. The differing Miller indices result in analogous, but nevertheless unique surface arrangements of silver and halide ions.

While FIGS. 2, 4, 6, and 10 all contain bromide ions as the sole halide ions, it is appreciated that the same observations as to differences in the crystal faces obtain when each wholly or partially contains chloride ions instead. Although chloride ions are substantially smaller in effective diameter than bromide ions, a {321} hexoctahedral crystal surface presented by silver chloride would appear similar to the surface shown in FIG. 10.

The cubic crystal lattice structure silver halide grains containing hexoctahedral crystal faces can contain minor amounts of iodide ions, similarly as conventional silver halide grains. Iodide ions have an effective diameter substantially larger than that of bromide ions. As is well known in silver halide crystallography, this has a somewhat disruptive effect on the order of the crystal structure, which can be accommodated and actually employed photographically to advantage, provided the iodide ions are limited in concentration. Preferably iodide ion concentrations below 15 mole percent and optimally below 10 mole percent, based on silver, are employed in the practice of this invention. Iodide ion concentrations of up to 40 mole percent, based on silver, can be present in silver bromide crystals. Since iodide ions as the sole halide ions in silver halide do not form a cubic crystal lattice structure, their use alone has no applicabiity to this invention.

It is appreciated that the larger the proportion of the total silver halide grain surface area accounted for by hexoctahedral crystal faces the more distinctive the silver halide grains become. In most instances the hexoctahedral crystal faces account for at least 50 percent of the total surface area of the silver halide grains. Where the grains are regular, the hexoctahedral crystal faces can account for all of the flat crystal faces observable, the only remaining grain surfaces being attributable to edge rounding. In other words, silver halide grains having hexoctahedral crystal faces accounting for at least 90 percent of the total grain surface area are contemplated.

It is, however, appreciated that distinctive photographic effects may be realized even when the hexoctahedral crystal faces are limited in areal extent. For example, where in an emulsion containing the silver halide grains a photographic addendum is present that shows a marked adsorption preference for a hexoctahedral crystal face, only a limited percentage of the total grain surface may be required to produce a distinctive photographic effect. Generally, if any hexoctahedral crystal face is observable on a silver halide grain, it accounts for a sufficient proportion of the total surface area of the silver halide grain to be capable of influencing photographic peformance. Stated another way, by the time a hexoctahedral crystal face becomes large enough to be identified by its relative angle to adjacent crystal faces, it is already large enough to be capable of influencing photographic performance. Thus, the minimum proportion of total grain surface area accounted for by hexoctahedral crystal faces is limited only by the observer's ability to detect the presence of hexoctahedral crystal faces.

Figure 7:
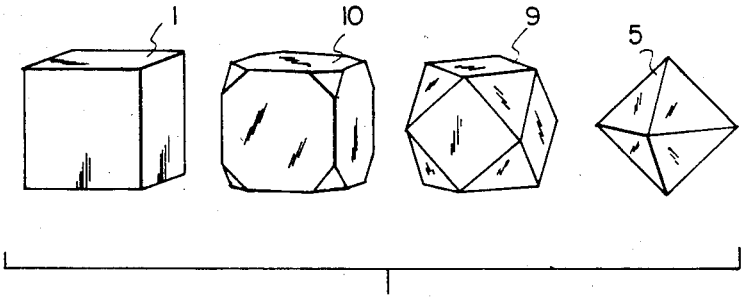
FIG. 7 is an isometric view of a regular cubic silver halide grain, a regular octahedral silver halide grain, and intermediate cubo-octahedral silver halide grains.

The successful formation of hexoctahedral crystal faces on silver halide grains of a cubic crystal lattice structure depends on identifying silver halide grain growth conditions that retard the surface growth rate on hexoctahedral crystal planes. It is generally recognized in silver halide crystallography that the predominant crystal faces of a silver halide grain are determined by choosing grain growth conditions that are least favorable for the growth of that crystal face. For example, regular cubic silver halide grains, such as grain 1, are produced under grain growth conditions that favor more rapid deposition of silver and halide ions on all other available crystal faces than on the cubic crystal faces. Referring to FIG. 7, if an octahedral grain, such as regular octahedral grain 5 is subjected to growth under conditions that least favor deposition of silver and halide ions onto cubic crystal faces, grain 5 during continued silver halide precipitation will progress through the intermediate cubo-octahedral grain forms 9 and 10 before reaching the final cubic grain configuration 1. Once only cubic crystal faces remain, then silver and halide ions deposit isotropically on these surfaces. In other words, the grain shape remains cubic, and the cubic grains merely grow larger as additional silver and halide ions are precipitated.

By analogy, grains having hexoctahedral crystal faces have been prepared by introducing into a silver halide precipitation reaction vessel host grains of conventional crystal faces, such as cubic grains, while maintaining growth conditions to favor retarding silver halide deposition along hexoctahedral crystal faces. As silver halide precipitation continues hexoctahedral crystal faces first become identifiable and then expand in area until eventually, if precipitation is continued, they account for all of the crystal faces of the silver halide grains being grown. Since hexoctahedral crystal faces accept additional silver halide deposition at a slow rate, renucleation can occur, creating a second grain population. Precipitation conditions can be adjusted by techniques generally known in the art to favor either continued grain growth or renucleation.

Failure of the art to observe hexoctahedral crystal faces for silver halide grains over decades of intense investigation as evidenced by published silver halide crystallographic studies suggests that there is not an extensive range of conditions that favor the selective retarding of silver halide deposition along hexoctahedral crystal faces. It has been discovered that growth modifiers can be employed to retard silver halide deposition selectively at hexoctahedral crystal faces, thereby producing these hexoctahedral crystal faces as the external surfaces of the silver halide grains being formed. The growth modifiers which have been identified are organic compounds. They are believed to be effective by reason of showing an adsorption preference for a hexoctahedral crystal face by reason of its unique arrangement of silver and halide ions. Growth modifiers that have been empirically proven to be effective in producing hexoctahedral crystal faces are described in the examples, below.

These growth modifiers are effective under the conditions of their use in the examples. From empirical screening of a variety of candidate growth modifiers under differing conditions of silver halide precipitation it has been concluded that multiple parameters must be satisfied to achieve hexoctahedral crystal faces, including not only the proper choice of a growth modifier, but also proper choice of other precipitation parameters identified in the examples. Failures to achieve hexoctahedral crystal faces with compounds shown to be effective as growth modifiers for producing hexoctahedral crystal faces have been observed when accompanying conditions for silver halide precipitation have been varied. However, it is appreciated that having demonstrated success in the preparations of silver halide emulsions containing grains with hexoctahedral crystal faces, routine empirical studies systematically varying parameters are likely to lead to additional useful preparation techniques.

Once silver halide grain growth conditions are satisfied that selectively retard silver halide deposition at hexoctahedral crystal faces, continued grain growth usually results in hexoctahedral crystal faces appearing on all the grains present in the silver halide precipitation reaction vessel. It does not follow, however, that all of the radiation sensitive silver halide grains in the emulsions of the present invention must have hexoctahedral crystal faces. For example, silver halide grains having hexoctahedral crystal faces can be blended with any other conventional silver halide grain population to produce the final emulsion. White silver halide emulsions containing any identifiable hexoctahedral crystal face grain surface are considered within the scope of this invention, in most applications the grains having at least one identifiable hexoctahedral crystal face account for at least 10 percent of the total grain population and usually these grains will account for greater than 50 percent of the total grain population.

The emulsions of this invention can be substituted for conventional emulsions to satisfy known photographic applications. In addition, the emulsions of this invention can lead to unexpected photographic advantages.

For example, when a growth modifier is present adsorbed to the hexoctahedral crystal faces of the grains and has a known photographic utility that is enhanced by adsorption to a grain surface, either because of the more intimate association with the grain surface or because of the reduced mobility of the growth modifier, improved photographic performance can be expected. The reason for this is that for the growth modifier to produce a hexoctahedral crystal face it must exhibit an adsorption preference for the hexoctahedral crystal face that is greater than that exhibited for any other possible crystal face. This can be appreciated by considering growth in the presence of an adsorbed growth modifier of a silver halide grain having both cubic and hexoctahedral crystal faces. If the growth modifier shows an adsorption preference for the hexoctahedral crystal faces over the cubic crystal faces, deposition of silver and halide ions onto the hexoctahedral crystal faces is retarded to a greater extent than along the cubic crystal faces, and grain growth results in the elimination of the cubic crystal faces in favor of hexoctahedral crystal faces. From the foregoing it is apparent that growth modifiers which produce hexoctahedral crystal faces are more tightly adsorbed to these grain surfaces than to other silver halide grain surfaces during grain growth, and this enhanced adsorption carries over to the completed emulsion.

To provide an exemplary photographic application, Locker U.S. Pat. No. 3,989,527 describes improving the speed of a photographic element by employing an emulsion containing radiation sensitive silver halide grains having a spectral sensitizing dye adsorbed to the grain surfaces in combination with silver halide grains free of spectral sensitizing dye having an average diameter chosen to maximize light scattering, typically in the 0.15 to 0.8 μm range. Upon imagewise exposure radiation striking the undyed grains is scattered rather than being absorbed. This results in an increased amount of exposing radiation striking the radiation sensitive imaging grains having a spectral sensitizing dye adsorbed to their surfaces.

A disadvantage encountered with this approach has been that spectral sensitizing dyes can migrate in the emulsion, so that to some extent the initially undyed grains adsorb spectral sensitizing dye which has migrated from the initially spectrally sensitized grains. To the extent that the initially spectrally sensitized grains were optimally sensitized, dye migration away from their surfaces reduces sensitization. At the same time, adsorption of dye on the grains intended to scatter imaging radiation reduces their scattering efficiency.

In the examples below it is to be noted that a specific spectral sensitizing dye has been identified as a growth modifier useful in forming silver halide grains having hexoctahedral crystal faces. When radiation sensitive silver halide grains having hexoctahedral crystal faces and a growth modifier spectral sensitizing dye adsorbed to the hexoctahedral crystal faces are substituted for the spectrally sensitized silver halide grains employed by Locker, the disadvantageous migration of dye from the hexoctahedral crystal faces to the silver halide grains intended to scatter light is reduced or eliminated. Thus, an improvement in photographic efficiency can be realized.

To illustrate another advantageous photographic application, the layer structure of a multicolor photographic element which introduces dye image providing materials, such as couplers, during processing can be simplified. An emulsion intended to record green exposures can be prepared using a growth modifier that is a green spectral sensitizing dye while an emulsion intended to record red exposures can be prepared using a growth modifier that is a red spectral sensitizing dye. Since the growth modifiers are tightly adsorbed to the grains and non-wandering, instead of coating the green and red emulsions in separate color forming layer units, as is conventional practice, the two emulsions can be blended and coated as a single color forming layer unit. The blue recording layer can take any conventional form, and a conventional yellow filter layer can be employed to protect the blended green and red recording emulsions from blue light exposure. Except for blending the green and red recording emulsions in a single layer or group of layers differing in speed in a single color forming layer unit, the structure and processing of the photographic element is unaltered. If silver chloride emulsions are employed, the approach described above can be extended to blending in a single color forming layer unit blue, green, and red recording emulsions, and the yellow filter layer can be eliminated. The advantage in either case is a reduction in the number of emulsion layers required as compared to a corresponding conventional multicolor photographic element.

In more general applications, the substitution of an emulsion according to the invention containing a growth modifier spectral sensitizing dye should produce a more invariant emulsion in terms of spectral properties than a corresponding emulsion containing silver halide grains lacking hexoctahedral crystal faces. Where the growth modifier is capable of inhibiting fog, such as nitrobenzimidazole or 5-carboxy-4-hydroxy-1,3,3a,7-tetraazaindene, shown to be effective growth modifiers in the examples, more effective fog inhibition at lower concentrations may be expected. It is recognized that a variety of photographic effects, such as photographic sensitivity, minimum background density levels, latent image stability, nucleation, developability, image tone, absorption, and reflectivity, are influenced by grain surface interactions with other components. By employing components, such as peptizers, silver halide solvents, sensitizers or desensitizers, supersensitizers, halogen acceptors, dyes, antifoggants, stabilizers, latent image keeping agents, nucleating agents, tone modifiers, development accelerators or inhibitors, development restrainers, developing agents, and other addenda that are uniquely matched to the hexoctahedral crystal surface, distinct advantages in photographic performance over that which can be realized with silver halide grains of differing crystal faces are possible.

The silver halide grains having hexoctahedral crystal faces can be varied in their properties to satisfy varied known photographic applications as desired. Generally the techniques for producing surface latent image forming grains, internal latent image forming grains, internally fogged grains, surface fogged grains, and blends of differing grains described in *Research Disclosure,* Vol. 176, December 1978, Item 17643, Section I, can be applied to the preparation of emulsions according to this invention. *Research Disclosure* is published by Kenneth Mason Publications, Ltd., Emsworth, Hampshire P010 7DD, England. The silver halide grains having hexoctahedral crystal faces can have silver salt deposits on their surfaces, if desired. Selective site silver salt deposits on host silver halide grains are taught by Maskasky U.S. Pat. Nos. 4,463,087 and 4,471,050, here incorporated by reference.

The growth modifier used to form the hexoctahedral crystal faces of the silver halide grains can be retained in the emulsion, adsorbed to the grain faces, displaced from the grain faces or destroyed. For example, where, as noted above, the growth modifier is also capable of acting as a spectral sensitizing dye or performing some other useful function, it is advantageous to retain the growth modifier in the emulsion. Where the growth modifier is not relied upon to perform an additional useful photographic function, its presence in the emulsion can be reduced or eliminated, if desired, once its intended function is performed. This approach is advantageous where the growth modifier is at all disadvantageous in the environment of use. The growth modifier can itself be modified by chemical interactions, such as oxidation, hydrolysis, or addition reactions, accomplished with reagents such as bromine water, base, or acid—e.g., nitric, hydrochloric, or sulfuric acid.

Apart from the novel grain structures identified above, the radiation sensitive silver halide emulsions and the photographic elements in which they are incorporated of this invention can take any convenient conventional form. The emulsions can be washed as described in *Research Disclosure,* Item 17643, cited above, Section II.

The radiation sensitive silver halide grains of the emulsions can be surface chemically sensitized. Noble mettal (e.g., gold), middle chalcogen (e.g., sulfur, selenium, or tellurium), and reduction sensitizers, employed individually or in combination are specifically contemplated. Typical chemical sensitizers are listed in *Research Disclosure,* Item 17643, cited above, Section III. From comparisons of surface halide and silver ion arrangements in general the chemical sensitization response of silver halide grains having hexoctahedral crystal faces should be analogous, but not identical, to that of cubic and octahedral silver halide grains. That observation can be extended to emulsion addenda generally which adsorb to grain surfaces.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure,* Item 17643, cited above, Section IV.

The silver halide emulsions as well as other layers of the photographic elements of this invention can contain as vehicles hydrophilic colloids, employed alone or in combination with other polymeric materials (e.g., latices). Suitable hydrophilic materials include both naturally occurring substances such as proteins, protein derivatives, cellulose derivatives—e.g., cellulose esters, gelatin—e.g., alkali treated gelatin (cattle, bone, or hide gelatin) or acid treated gelatin (pigskin gelatin), gelatin derivatives—e.g., acetylated gelatin, phthalated gelatin, and the like, polysaccharides such as dextran, gum arabic, zein, casein, pectin, collagen derivatives, collodion, agar-agar, arrowroot, and albumin. It is specifically contemplated to employ hydrophilic colloids which contain a low proportion divalent sulfur atoms. The proportion of divalent sulfur atoms can be reduced by treating the hydrophilic colloid with a strong oxidizing agent, such as hydrogen peroxide. Among preferred hydrophilic colloids for use as peptizers for the emulsions of this invention are gelatino-peptizers which contain less than 30 micromoles of methionine per gram. Preferred hydrophilic colloids are disclosed in Maskasky U.S. Ser. No. 811,133, filed Dec. 18, 1985, titled A PROCESS FOR PRECIPITATING A TABULAR GRAIN EMULSION IN THE PRESENCE OF A GELATINO-PIPTIZER AND AN EMULSION PRODUCED THEREBY, commonly assigned. The vehicles can be hardened by conventional procedures. Further details of the vehicles and hardeners are provided in *Research Disclosure,* Item 17643, cited above, Sections IX and X.

The silver halide photographic elements of this invention can contain other addenda conventional in the photographic art. Useful addenda are described, for example, in *Research Disclosure,* Item 17643, cited above. Other conventional useful addenda include antifoggants and stabilizers, couplers (such as dye forming couplers, masking couplers and DIR couplers) DIR compounds, anti-stain agents, image dye stabilizers, absorbing materials such as filter dyes and UV absorbers, light scattering materials, antistatic agents, coating aids, and plasticizers and lubricants.

The photographic elements of the present invention can be simple black-and-white or monochrome elements comprising a support bearing a layer of the silver halide emulsion, or they can be multilayer and/or multicolor elements. The photographic elements produce images ranging from low contrast to very high contrast, such as those employed for producing half tone images in graphic arts. They can be designed for processing with separate solutions or for in-camera processing. In the latter instance the photographic elements can include conventional image transfer features, such as those illustrated by *Research Disclosure,* Item 17643, cited above, Section XXIII. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image forming units, can be arranged in various orders as known in the art. In an alternative format, the emulsion or emulsions can be disposed as one or more segmented layers, e.g., as by the use of microvessels or microcells, as described in Whitmore U.S. Pat. No. 4,387,154.

A preferred multicolor photographic element according to this invention containing incorporated dye image providing materials comprises a support bearing at least one blue sensitive silver halide emulsion layer having associated therewith a yellow dye forming coupler, at least one green sensitive silver halide emulsion layer having associated therewith a magenta dye forming coupler, and at least one red sensitive silver halide emulsion layer having associated therewith a cyan dye forming coupler, at least one of the silver halide emulsion layers containing grains having hexoctahedral crystal faces as previously described.

The elements of the present invention can contain additional layers conventional in photographic elements, such as overcoat layers, spacer layers, filter layers, antihalation layers, and scavenger layers. The support can be any suitable support used with photographic elements. Typical supports include polymeric films, paper (including polymer-coated paper), glass, and metal supports. Details regarding supports and other layers of the photographic elements of this invention are contained in *Research Disclosure,* Item 17643, cited above, Section XVII.

The photographic elements can be imagewise exposed with various forms of energy, which encompass the ultraviolet, visible, and infrared regions of the electromagnetic spectrum as well as electron beam and beta radiation, gamma ray, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements, such as those illustrated in *Research Disclosure,* Vol. 184, August 1979, Item 18431.

Processing of the imagewise exposed photographic elements can be accomplished in any convenient conventional manner. Processing procedures, developing agents, and development modifiers are illustrated by *Research Disclosure,* Item 17643, cited above, Sections XIX, XX, and XXI, respectively.

EXAMPLES

The invention can be better appreciated by reference to the following specific examples. In each of the examples the term "percent" means percent by weight, unless otherwise indicated, and all solutions, unless otherwise indicated, are aqueous solutions. Dilute nitric acid or dilute sodium hydroxide was employed for pH adjustment, as required.

EXAMPLE 1

This example illustrates the preparation of a hexoctahedral silver bromide emulsion having the Miller index {321}, beginning with a cubic host emulsion.

To a reaction vessel supplied with a stirrer was added 0.5 g of bone gelatin dissolved in 28.5 g of water. To this was added 0.05 mole of a cubic silver bromide emulsion of mean grain size 0.8 μm, containing about 10 g/Ag mole gelatin, and having a total weight of 21.6 g. The emulsion was heated to 40° C., and 0.3 millimole/Ag mole of 6-nitrobenzimidazole dissolved in 2 mL. methanol was added. The mixture was held for 15 min. at 40° C. The pH was adjusted to 6.0 at 40° C. The emulsion was then heated to 60° C., and the pAg adjusted to 8.5 at 60° C. with KBr, and maintained at that value during the precipitation. A 2.5M solution of $AgNO_3$ and a 2.5M solution of KBr were then introduced with a constant silver addition rate over a period of 50 min., consuming 0.025 mole Ag. The precipitation was then stopped, and an additional 6.0 millimoles/- original Ag mole of 6-nitrobenzimidazole dissolved in 2 ml of methanol were added. The precipitation was then continued at the same rate as before for 10 minutes, consuming an additional 0.005 mole Ag. At this stage a sample (Emulsion 1A) was removed. The precipitation was continued for a further 65 min., during which an additional 0.0325 mole Ag was consumed, to produce Emulsion 1B.

Figure 11:
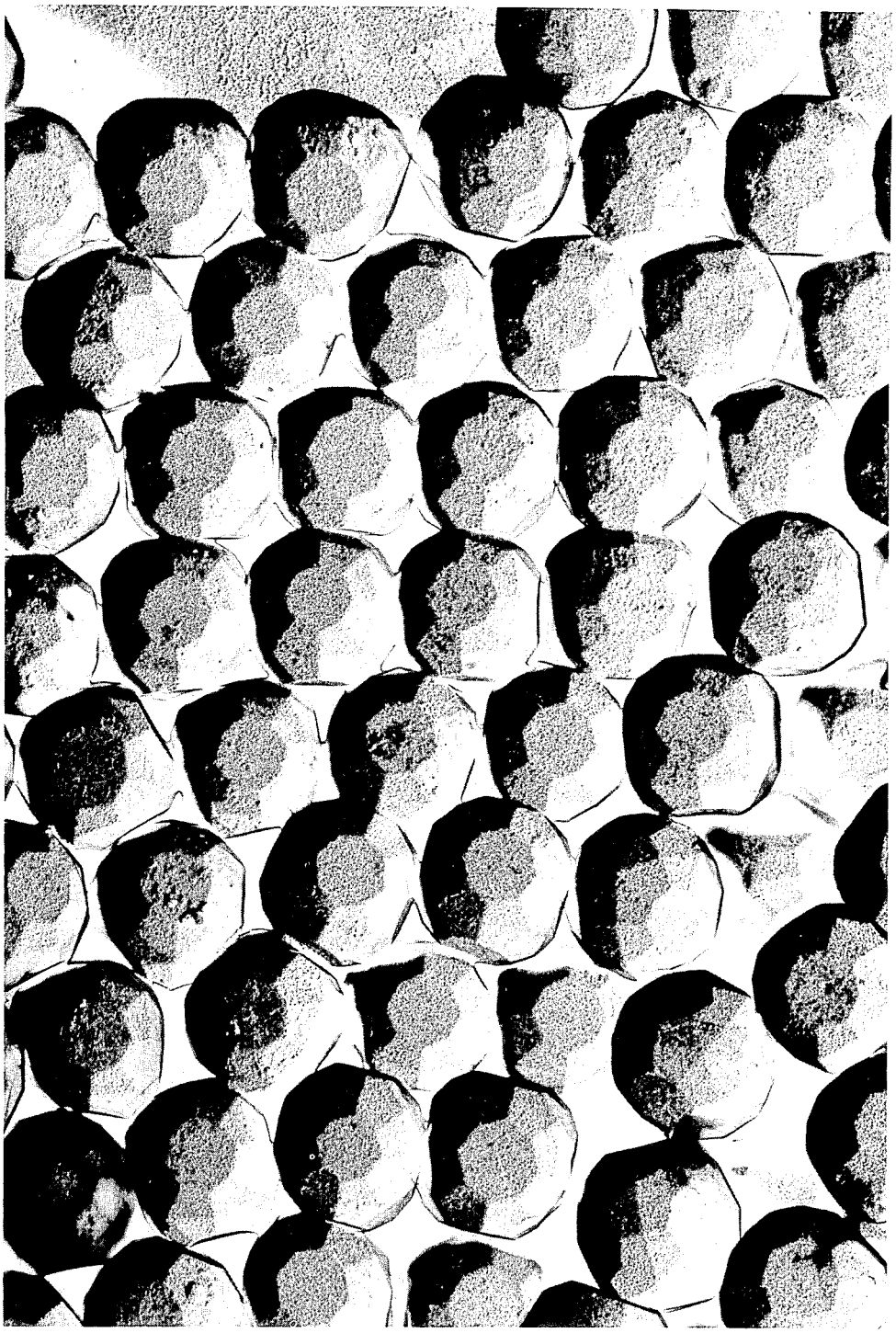
FIGS. 11 through 15 are electron micrographs of hexoctahedral silver halide grains.
Figure 12:
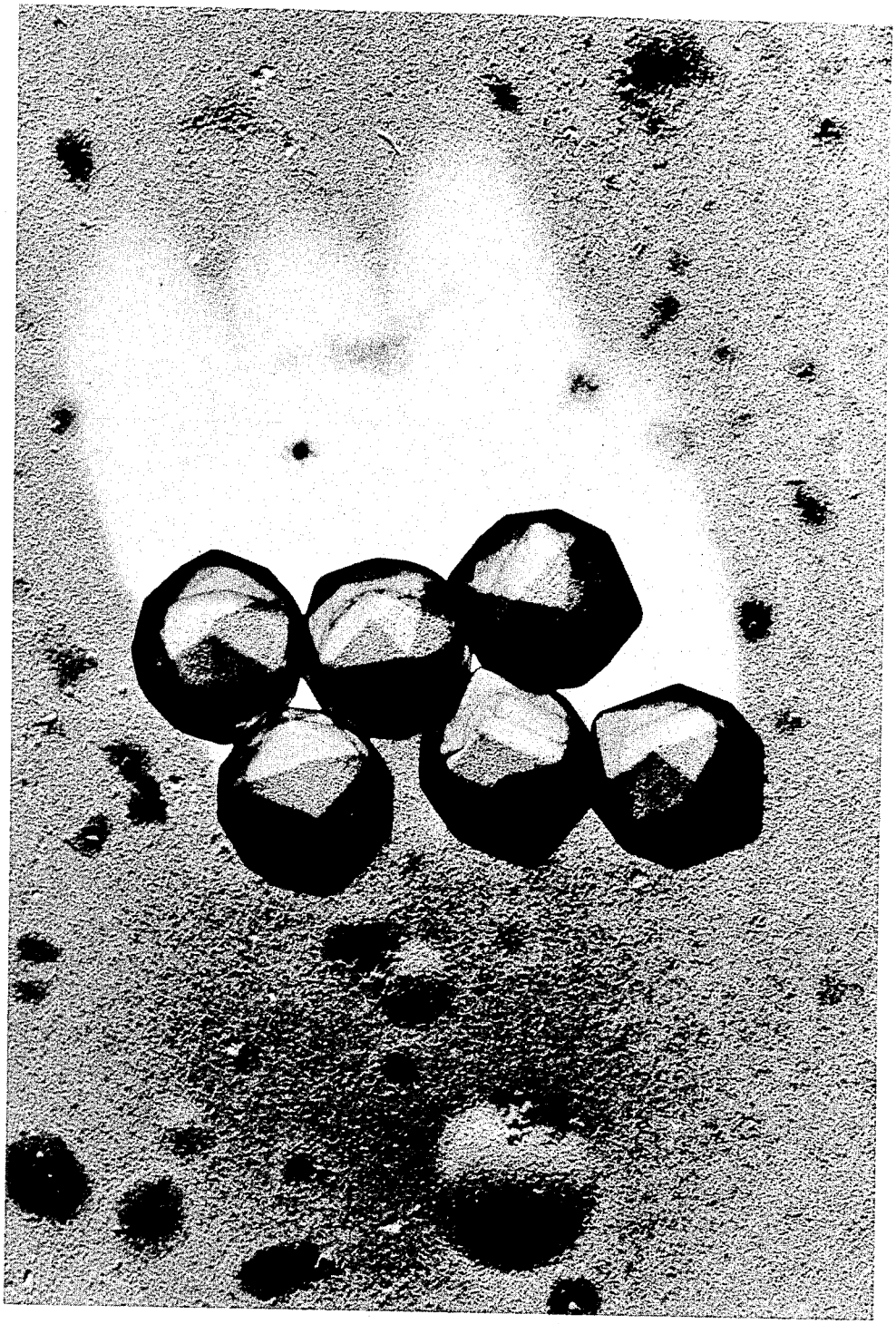

A carbon replica electron micrograph (FIG. 11) shows Emulsion 1A to have a combination of cubic and hexoctahedral faces. Emulsion 1B (FIG. 12) has hexoctahedral faces only. The Miller index of the hexoctahedral faces was determined by measurement of the relative angle between two adjacent hexoctahedral crystal faces. From this angle, the supplement of the relative angle, which is the angle between their respective crystallographic vectors, Φ, could be obtained, and the Miller index of the adjacent hexoctahedral crystal faces was identified by comparison of this angle Φ with the theoretical intersecting angle $\theta$ between $[h_1k_1l_1]$ and $[h_2k_2l_2]$ vectors. The angle $\theta$ was calculated as described by Phillips, cited above, at pages 218 and 219.

To obtain the angle Φ, a carbon replica of the crystal sample was rotated on the stage of an electron microscope until, for a chosen crystal, the angle of observation was directly along the line of intersection of the two adjacent crystal faces of interest. An electron micrograph was then made, and the relative angle was measured on the micrograph with a protractor. The supplement of the measured relative angle was the angle Φ between vectors. The results for Emulsions 1A and 1B for each of the vector angles corresponding to the three different relative angles measured are given below. The number of measurements made is given in parentheses. Theoretical Miller indices as high as {543} were considered.

| | Angle Between Vectors | | |
|---|---|---|---|
| Theoretical {321} | 31.0° | 21.8° | 44.4° |
| Measured, Emulsion 1A | 30.5 ± 1.0°(4) | 21°(1) | 45°(1) |
| Emulsion 1B | 32.0 ± 1.9°(4) | 21°(1) | — |

The emulsions of this example therefore show {321} hexoctahedral faces, with Emulsion 1B, which is composed of regular hexoctahedra, showing only {321} crystal faces.

EXAMPLE 2

This example illustrates the preparation of a hexoctahedral silver bromide emulsion having the Miller index {321} beginning with an octahedral host emulsion.

To a reaction vessel supplied with a stirrer was added 0.10 mole of an octahedral AgBr emulsion, containing 40 g/Ag mole gelatin, of mean grain size 1.3 μm, diluted to 55 mL. with water. The emulsion was heated to 40° C., and 4.0 millimole/mole startup Ag of 6-nitrobenzimidazole dissolved in 3 mL. of methanol was added. The mixture was held 15 min. at 40° C. The temperature was then raised to 60° C. The pAg was adjusted to 8.5 at 60° C. with KBr and maintained at that value during the precipitation. The pH was adjusted to 6.0 at 60° C. and maintained at that value. A 2.0M solution of $AgNO_3$ and a 2.0M solution of KBr were simultaneously added over a period of 400 min., with a constant silver addition rate consuming 0.08 mole Ag.

Figure 13:
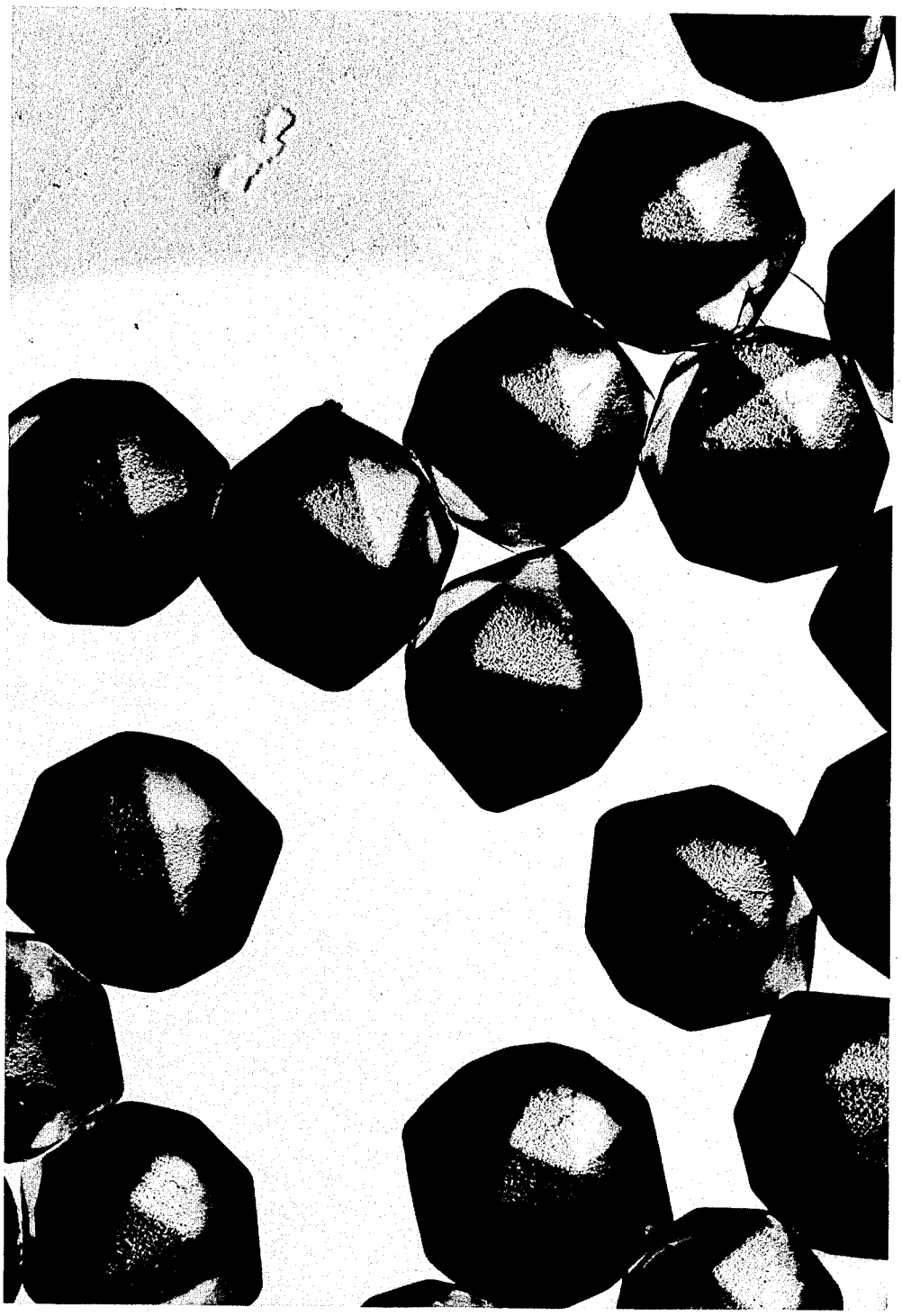

FIG. 13 is an electron micrograph showing the hexoctahedral habit of the emulsion prepared. The Miller index was observed to be {321}.

EXAMPLE 3

This example illustrates the preparation of a hexoctahedral silver bromide emulsion having the Miller index {521} beginning with a cubic host emulsion.

To a reaction vessel supplied with a stirrer was added 0.05 mole of a cubic silver bromide emulsion of mean grain size 0.08 μm, containing about 10 g/Ag mole of gelatin. Water was added to make the total weight 50 g. To the emulsion at 40° C. was added 3.0 millimole/Ag mole of the growth modifier spectral sensitizing dye 3-carboxymethyl-5-{[3-(3-sulfopropyl)-2-thiazolidinylidene]ethylidene}rhodanine, sodium salt (structure shown below), hereinafter referred to as Dye I, dissolved in 3 mL. of methanol, 2 mL. water, and 3 drops of triethylamine.

Dye I

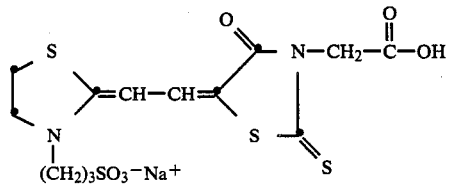

Figure 14:
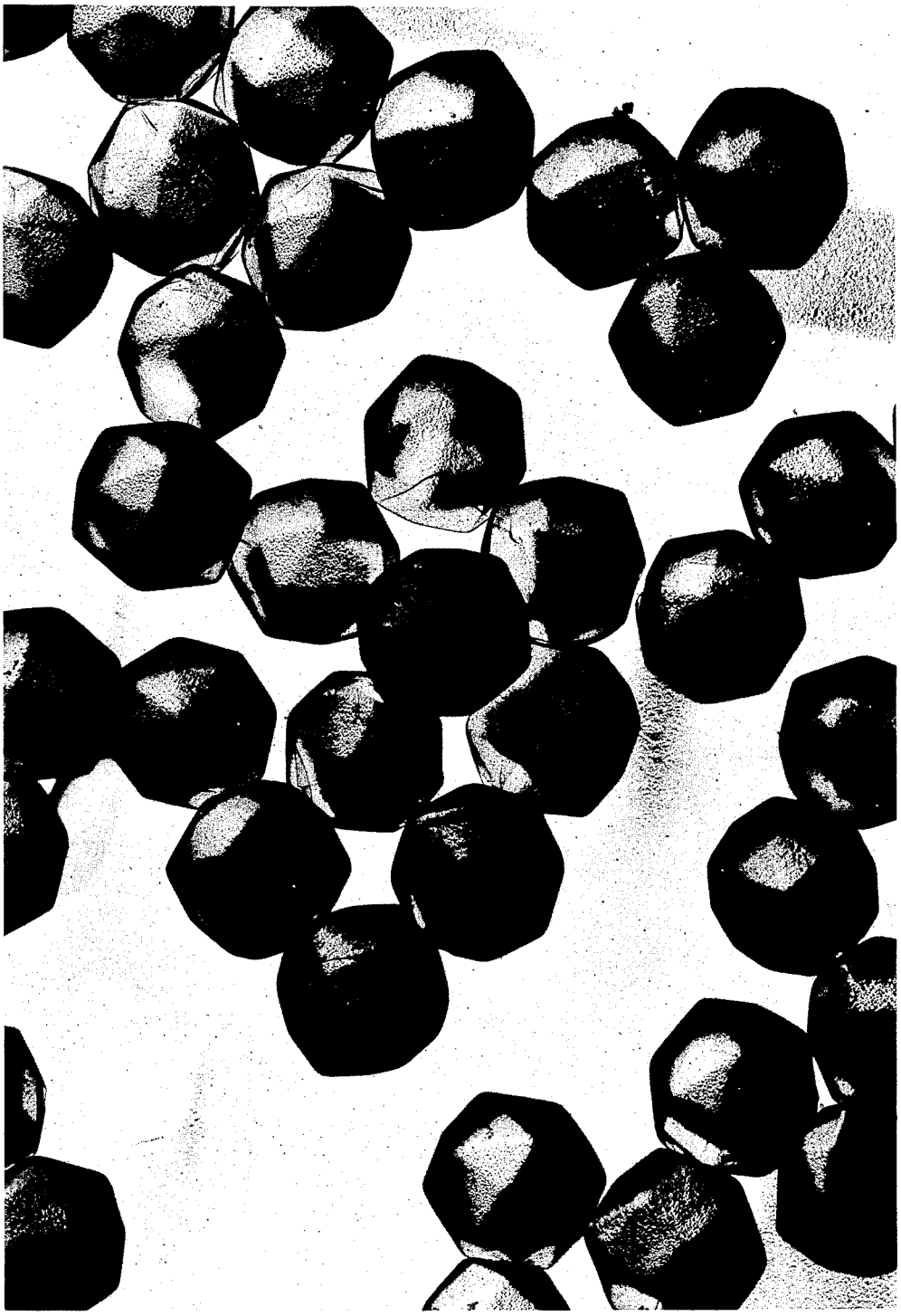

The emulsion was then held for 15 min. at 40° C. The pH was adjusted to 6.0 at 40° C. The temperature was raised to 60° C., and the pAg adjusted to 8.5 at 60° C. with KBr and maintained at that value during the precipitation. A 2.5M solution of $AgNO_3$ was introduced at a constant rate over a period of 125 min. while a 2.5M solution of KBr was added as needed to hold the pAg constant. A total of 0.0625 mole Ag was needed. An electron mirograph of the resulting hexoctahedral emulsion grains is shown in FIG. 14.

The Miller index of the hexoctahedra of the prepared emulsion was determined to be {521} by the method described for Example 1.

| | Angle Between Vectors | |
|---|---|---|
| Theoretical {521} | 21.0° | 45.6° |
| Measured | 22.9 ± 1.4°(10) | 45.6 ± 3.2°(15) |

EXAMPLE 4

This example illustrates the preparation of a hexoctahedral silver chloride emulsion having the Miller index {521}.

Figure 15:
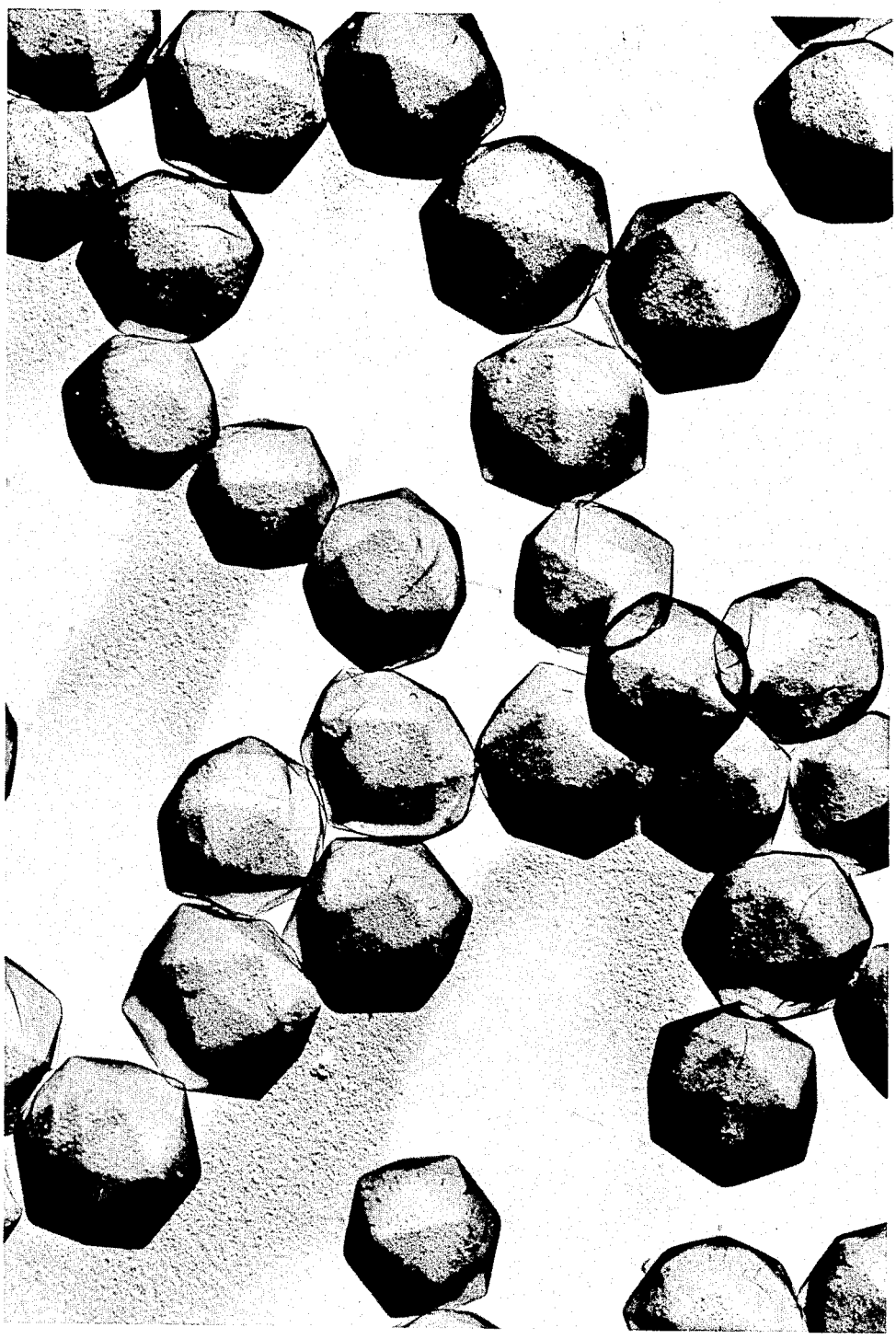

To a reaction vessel supplied with a stirrer was added 0.05 mole of a cubic silver chloride emulsion of mean grain size 0.65 μm and containing 40 g/Ag mole gelatin. Water was added to make the total weight 48 g. To the emulsion at 40° C. was added 2.0 millimole/Ag mole of Dye I dissolved in 3 mL. of methanol, 1.5 mL. water, and 2 drops of triethylamine. The emulsion was then held for 15 min. at 40° C. The temperature was then raised to 50° C. The pH was adjusted to 5.92 at 50° C., and maintained at about this value during the precipitation by NaOH addition. The pAg was adjusted to 7.7 at 50° C. with NaCl solution and maintained during the precipitation. A 2.0M solution of $AgNO_3$ was introduced at a constant rate over a period of 200 min., while a 2.2M solution of NaCl was added as needed to hold the pAg constant. A total of 0.04 mole Ag was added. An electron micrograph of the resulting hexoctahedral emulsion grains is shown in FIG. 15. The Miller index of the grains was observed to be {521}.

EXAMPLE 5

This example illustrates additional growth modifiers capable of producing hexoctahedral crystal faces and lists potential growth modifiers investigated, but not observed to produce hexoctahedral crystal faces.

The grain growth procedures employed were of two different types:

A. The first grain growth procedure was as follows: To a reaction vessel supplied with a stirrer was added 0.5 g of bone gelatin dissolved in 28.5 g of water. To this was added 0.05 mole of silver bromide host grain emulsion of mean grain size 0.8 μm, containing about 10 g/Ag mole gelatin, and having a total weight of 21.6 g. The emulsion was heated to 40° C., and 6.0 millimoles/Ag mole of dissolved growth modifier were added. The mixture was held for 15 min. at 40° C. The pH was adjusted to 6.0 at 40° C. The emulsion was then heated to 60° C., and the pAg was adjusted to 8.5 at 60° C. with KBr and maintained at that value during the precipitation. The pH, which shifted to 5.92 at 60° C., was held at that value thereafter. A 2.5M solution of $AgNO_3$ and a 2.5M solution of KBr were then introduced with a constant silver addition rate over a period of 125 min., consuming 0.0625 mole Ag.

Cubic or octahedral host grains were employed as noted in Table I. Small samples of emulsion were withdrawn at intervals during the precipitation for electron microscope examination, any hexoctahedral crystal faces revealed in such samples are reported in Table I.

B. The second grain growth procedure employed 7.5 millimoles of a freshly prepared very fine grain (approximately 0.02 μm) AgBr emulsion to which was added 0.09 millimole of growth modifier. In this process these very fine AgBr grains were dissolved and reprecipitated onto the host grains. The host grain emulsion contained 0.8 μm AgBr grains. A 7.5 millimole portion of the host grain emulsion was added to the very fine grain emulsion. A pH of 6.0 and pAg of 9.3 at 40° C. was employed. The mixture was stirred at 60° C. for about 19 hours.

The crystal faces presented by the host grains are as noted in Table I. Where both octahedral and cubic host grains are noted using the same growth modifier, a mixture of 5.0 millimoles cubic grains of 0.8 μm and 2.5 millimoles of octahedral grains of 0.8 μm was employed giving approximately the same number of cubic and octahedral host grains. In looking at the grains produced by ripening, those produced by ripening onto the cubic grains were readily visually distinguished, since they were larger. Thus, it was possible in one ripening process to determine the crystal faces produced using both cubic and octahedral host grains.

Differences in individual procedures are indicated by footnote. The {hkl surface column of Table I refers to those surfaces which satisfy the definition above for hexoctahedral crystal faces.

TABLE I

| | Growth Modifier | {hkl} Surfaces | Host Grains | Method |
|---|---|---|---|---|
| 1 | 5-Nitro-o-phenyleneguanidine nitrate | Yes | cubic | B |
| 2 | Citric acid, trisodium salt | None | cubic | B |
| 3 | 5-Nitroindazole | None | cubic | B |
| | | None | octahedral | B |
| 4 | 1-Phenyl-5-mercaptotetrazole | None | octahedral (1) (2) | A |
| 5 | 5-Bromo-1,2,3-benzotriazole | None | cubic | A |
| | | None | octahedral | B |
| 6 | 6-Chloro-4-nitro-1,2,3-benzotriazole | None | cubic | B |
| | | None | octahedral | B |
| 7 | 5-Chloro-1,2,3-benzotriazole | None | cubic | B |
| | | None | octahedral | B |
| 8 | 5-Chloro-6-nitro-1,2,3-benzotriazole | None | cubic | B |
| 9 | 3-Methyl-1,3-benzothiazolium p-toluenesulfonate | None | cubic | B |
| | | None | octahedral | B |
| 10 | 4-Hydroxy-6-methyl-1,3,3a,7-tetraazaindene, sodium salt | None | octahedral | B |
| 11 | 4-Hydroxy-6-methyl-2-methylmercapto-1,3,3a,7-tetraazaindene | None | cubic | A |
| 12 | 2,6,8-Trichloropurine | None | cubic | B |
| | | None | octahedral | B |
| 13 | 2-Mercapto-1-phenylbenzimidazole | None | cubic | B |
| | | None | octahedral | B |
| 14 | 3,6-Dimethyl-4-hydoxy-1,2,3a,7-tetraazaindene | None | cubic | B |
| | | None | octahedral | B |
| 15 | 5-Carboxy-4-hydroxy-1,3,3a,7-tetraazaindene | None | cubic | B |
| | | None | octahedral | B |
| 16 | 5-Carbethoxy-4-hydroxy-1,3,3a,7-tetraazaindene | Yes | cubic | A |
| 17 | 5-Imino-3-thiourazole | None | cubic | B |
| | | None | octahedral | B |
| 18 | 2-Formamidinothiomethyl-4-hydroxy-6-methyl-1,3,3a,7-tetraazaindene | None | cubic | B |
| | | None | octahedral | B |
| 19 | 4-Hydroxy-2-β-hydroxyethyl-6-methyl-1,3,3a,7-tetraazaindene | None | cubic | B |
| | | None | octahedral | B |
| 20 | 6-Methyl-4-phenylmercapto-1,3,3a,7-tetraazaindene | None | cubic | B |
| | | None | octahedral | B |
| 21 | 2-Mercapto-5-phenyl-1,3,4-oxadiazole | None | cubic | B |
| | | None | octahedral | B |
| 22 | 1,10-Dithia-4,7,13,16-tetraoxacyclooctadecane | None | cubic | B |
| | | None | octahedral | B |
| 23 | 2-Mercapto-1,3-benzothiazole | None | cubic | B |
| | | None | octahedral | B |
| 24 | 6-Nitrobenzimidazole | {321} | cubic (3) | A |
| 25 | 5-Methyl-1,2,3-benzotriazole | None | octahedral | B |
| 26 | Urazole | None | cubic | B |
| | | None | octahedral | B |
| 27 | 4,5-Dicarboxy-1,2,3-triazole, monopotassium salt | None | cubic | B |
| | | None | octahedral | B |
| 28 | 3-Mercapto-1,2,4-triazole | None | cubic | B |
| | | None | octahedral | B |
| 29 | 2-Mercapto-1,3-benzoxazole | None | cubic | B |
| | | None | octahedral | B |
| 30 | 6,7-Dihydro-4-methyl-6-oxo-1,3,3a,7-tetraazaindene | None | cubic | B |
| | | None | octahedral | B |
| 31 | 1,8-Dihydroxy-3,6-dithiaoctane | None | cubic | B |
| | | None | octahedral | B |
| 32 | 5-Ethyl-5-methyl-4-thiohydantoin | None | cubic | A |
| 33 | Ethylenethioura | None | cubic | A |
| | | None | octahedral | A |
| 34 | 2-Carboxy-4-hydroxy-6-methyl-1,3,3a,7-tetraazaindene | None | cubic | B |
| | | None | octahedral | B |
| 35 | Dithiourazole | None | cubic | B |
| | | None | octahedral | B |
| 36 | 2-Mercaptoimidazole | None | cubic | A |
| 37 | 5-Carbethoxy-3-(3-carboxypropyl)-4-methyl-4-thiazoline-2-thione | None | cubic | B |
| | | None | octahedral | B |
| 38 | Dithiourazole-methyl vinyl ketone monoadduct | None | cubic | B |

TABLE I-continued

| | Growth Modifier | {hkl} Surfaces | Host Grains | Method |
|---|---|---|---|---|
| | | None | octahedral | B |
| 39 | 1,3,4-Thiadiazolidine-2,5-dithione | None | cubic | B |
| | | None | octahedral | B |
| 40 | 4-Carboxymethyl-4-thiazoline-2-thione | None | cubic | B |
| | | None | octahedral | B |
| 41 | 1-Phenyl-5-selenoltetrazole, potassium salt | None | octahedral (1) (2) | A |
| 42 | 1-Carboxymethyl-5H—4-thiocyclopenta(d)uracil | None | octahedral | B |
| | | None | cubic | B |
| 43 | 5-Bromo-4-hydroxy-6-methyl-1,3,3a,7-tetraazaindene | None | cubic | A |
| 44 | 2-Carboxymethylthio-4-hydroxy-6-methyl-1,3,3a,7-tetraazaindene | None | cubic | B |
| 45 | 1-(3-Acetamidophenyl)-5-mercaptotetrazole, sodium salt | None | octahedral | B |
| 46 | 5-Carboxy-6-hydroxy-4-methyl-2-methylthio-1,3,3a,7-tetraazaindene | None | octahedral | B |
| 47 | 5-Carboxy-4-hydroxy-6-methyl-2-methylthio-1,3,3a,7-tetraazaindene | None | cubic | A |
| 48 | 1-Thiocaprolactam | None | cubic (1) | A |
| 49 | 4-Hydroxy-2-methylthio-1,3,3a,7-tetraazaindene | None | cubic | A |
| 50 | 4-Hydroxy-2,6-dimethyl-1,3,3a,7-tetraazaindene | None | octahedral (4) | A |
| 51 | Pyridine-2-thiol | None | octahedral (1) (8) | A |
| 52 | 4-Hydroxy-6-methyl-1,2,3a,7-tetraazaindene | None | octahedral (4) | A |
| 53 | 7-Ethoxycarbonyl-6-methyl-2-methylthio-4-oxo-1,3,3a,7-tetraazaindene | None | cubic | B |
| 54 | 1-(4-Nitrophenyl)-5-mercaptotetrazole | None | octahedral (1) (2) | A |
| 55 | 4-Hydroxy-1,3,3a,7-tetraazaindene | None | octahedral (4) | A |
| 56 | 2-Methyl-5-nitro-1-H—benzimidazole | None | octahedral | A |
| 57 | Benzenethiol | None | octahedral (1) (8) | A |
| 58 | Melamine | None | cubic | B |
| | | None | octahedral | B |
| 59 | 1-(3-Nitrophenyl)-5-mercaptotetrazole | None | cubic | B |
| | | None | octahedral | B |
| 60 | Pyridine-4-thiol | None | octahedral (1) | A |
| 61 | 4-Hydroxy-6-methyl-3-methylthio-1,2,3a,7-tetraazaindene | None | cubic | A |
| 62 | 4-Methoxy-6-methyl-1,3,3a,7-tetraazaindene | None | octahedral | A |
| 63 | 4-Amino-6-methyl-1,3,3a,7-tetraazaindene | None | octahedral | A |
| 64 | 4-Methoxy-6-methyl-2-methylthio-1,3,3a,7-tetraazaindene | None | cubic | A |
| 65 | 4-Hydroxy-6-methyl-1,2,3,3a,7-pentaazaindene | None | octahedral | A |
| 66 | 3-Carboxymethylrhodanine | None | cubic (1) | A |
| 67 | 1H—Benzimidazole | None | octahedral | A |
| 68 | 4-Nitro-1H—benzimidazole | None | octahedral | A |
| 69 | 3-Ethyl-5-[ (3-ethyl-2-benzoxazolinylidene)ethylidene]- | None | cubic | B |
| | 4-phenyl-2-thioxo-3-thiazolinium iodide | None | octahedral | B |

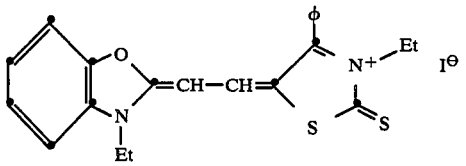

| | | | | |
|---|---|---|---|---|
| 70 | 3-Ethyl-5-(4-methyl-2-thioxo-3-thiazolin-5-ylidenemethyl)rhodanine | None | cubic | B |
| | | None | octahedral | B |

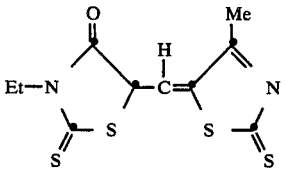

| | | | | |
|---|---|---|---|---|
| 71 | 3,3'-Diethylthiacyanine p-toluenesulfonate | None | cubic (5) | A |

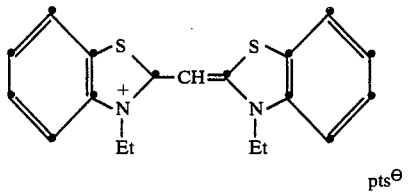

TABLE I-continued

| | Growth Modifier | {hkl} Surfaces | Host Grains | Method |
|---|---|---|---|---|
| 72 | 3-Ethyl-5-(3-ethyl-2-benzothiazolinylidene)rhodanine | None | cubic (5) | A |
| | 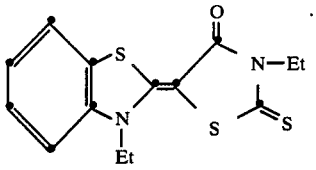 | | | |
| 73 | 3-Ethyl-5-(3-ethyl-2-benzothiazolinylidene)-2-thio-2,4-oxazolidinedione | None | cubic (5) | A |
| | 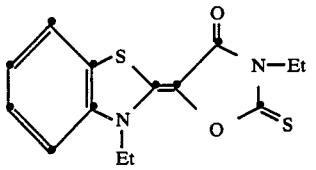 | | | |
| 74 | 5-(3-Ethyl-2-benzothiazolinylidene)-1,3-diphenyl-2-thiohydantoin | None | cubic | B |
| | 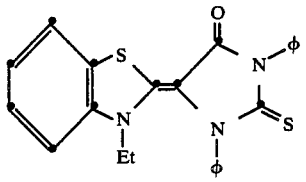 | None | octahedral | B |
| 75 | 3-Ethyl-5-(3-ethyl-2-benzoxazolinylidene)rhodanine | None | cubic (5) | A |
| | 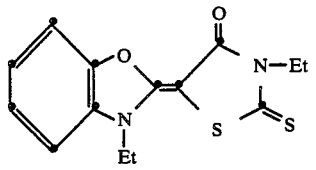 | | | |
| 76 | 3-Methyl-4-[(1,3,3-trimethyl-1(H)—2-indolylidene)-ethylidene]-1-phenyl-2-pyrazolin-5-one | None<br>None | cubic<br>octahedral | B<br>B |
| | 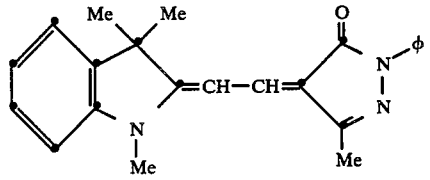 | | | |
| 77 | 5-(1,3-Dithiolan-2-ylidene)-3-ethylrhodanine | None | cubic (5) | A |
| | 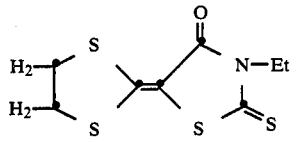 | | | |
| 78 | 5-(5-Methyl-3-propyl-2-thiazolinylidene)-3-propylrhodanine | None | cubic (5) | A |

TABLE I-continued

| | Growth Modifier | {hkl} Surfaces | Host Grains | Method |
|---|---|---|---|---|
| | 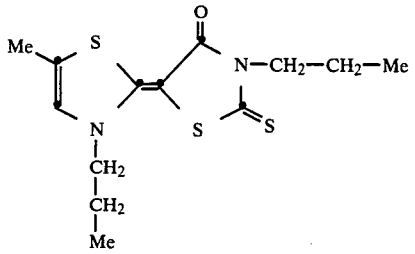 | | | |
| 79 | 3-Carboxymethyl-5-<br>[(3-ethyl-2-benzoxazolinylidene)ethylidene]rhodanine | None<br>None | cubic<br>octahedral | B<br>B |
| | 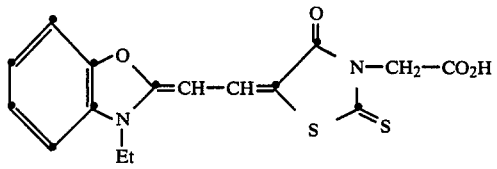 | | | |
| 80 | 5-(3-Ethyl-2-benzothiazolinylidene)-3-β-sulfoethylrhodanine | None | cubic (5) | A |
| | 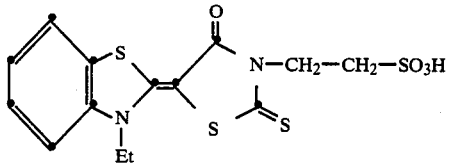 | | | |
| 81 | 5-Anilinomethylene-3-(2-sulfoethyl)rhodanine | None | cubic (6) | A |
| | 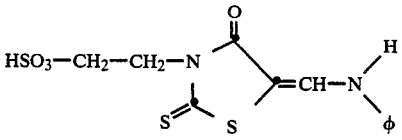 | | | |
| 82 | 3-(2-Carboxyethyl)-<br>5-[(3-ethyl-2-benzothiazolinylidene)ethylidene]rhodanine | None<br>None | cubic<br>octahedral | B<br>B |
| | 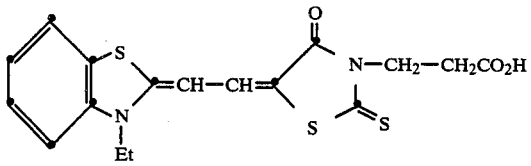 | | | |
| 83 | 1-Ethyl-4-(1-ethyl-4-pyridinylidene)-3-phenyl-2-thiohydantoin | None<br>None | cubic<br>octahedral | B<br>B |
| | 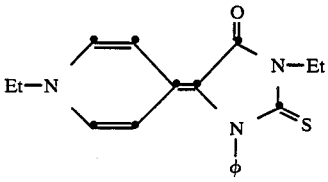 | | | |
| 84 | Anhydro-3-ethyl-9-<br>methyl-3'-(3-sulfobutyl)thiocarbocyanine hydroxide | None<br>None | cubic<br>octahedral | B<br>B |

TABLE I-continued

| | Growth Modifier | {hkl} Surfaces | Host Grains | Method |
|---|---|---|---|---|
| | 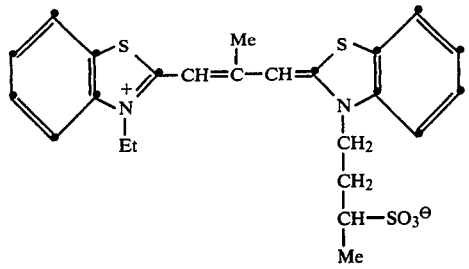 | | | |
| 85 | 3-Ethyl-5-[1-(4-sulfobutyl)-4-pyridinylidene]rhodanine, piperidine salt | None<br>None | cubic<br>octahedral | B<br>B |
| | 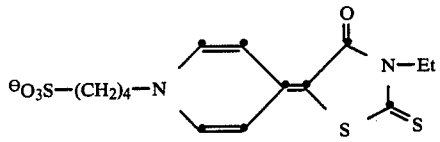 | | | |
| | 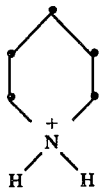 | | | |
| 86 | 5-(3-Ethyl-2-benzothiazolinylidene)-1-methoxycarbonylmethyl-3-phenyl-2-thiohydantoin | None<br>None | cubic<br>octahedral | B<br>B |
| | 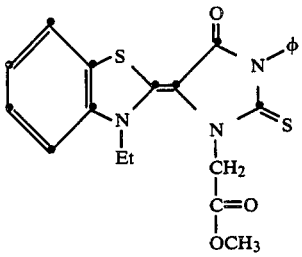 | | | |
| 87 | 3-(2-Carboxyethyl)-5-(1-ethyl-4-pyridinylidene)rhodanine | None | cubic (1) (2) | A |
| | 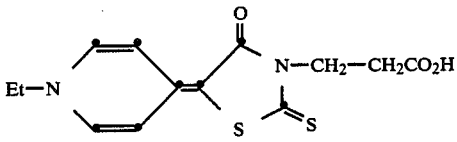 | | | |
| 88 | 3-Carboxymethyl-5-{[3-(3-sulfopropyl)-2-thiazolidinylidene]ethylidene}rhodanine, sodium salt | {521} | cubic (1) | A |
| | 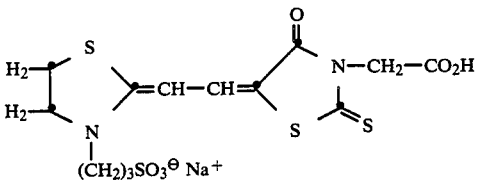 | | | |
| 89 | 3-(3-Carboxypropyl)-5-{[3-(3-sulfopropyl)-2-thiazolidinylidene]ethylidene}rhodanine, sodium salt | None | cubic (7) | A |

TABLE I-continued

| | Growth Modifier | {hkl} Surfaces | Host Grains | Method |
|---|---|---|---|---|
| | 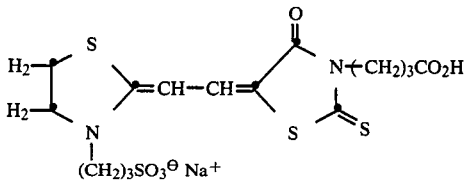 | | | |
| 90 | 3-(2-Carboxyethyl)-5-{[3-(3-sulfopropyl)-2-thiazolidinylidene]ethylidene}rhodanine, sodium salt | None | cubic<br>octahedral | B<br>B |
| | 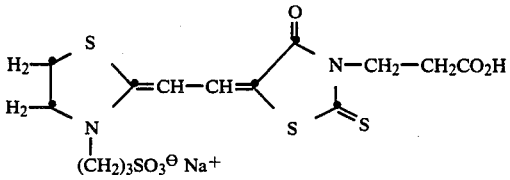 | | | |
| 91 | 3-Carboxymethyl-5-(2-pyrrolino-1-cyclopenten-1-ylmethylene)rhodanine, sodium salt | None | octahedral | A |
| | 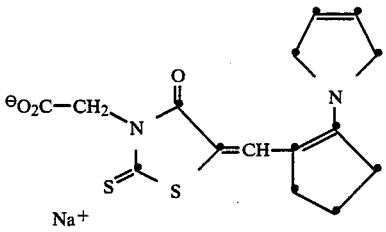 | | | |
| 92 | 3-Ethyl-5-(3-methyl-2-thiazolidinylidene)rhodanine | None | cubic (5) | A |
| | 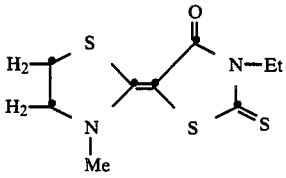 | | | |
| 93 | 5-(4-Sulfophenylazo)-2-thiocarbituric acid, sodium salt | None | cubic<br>octhedral | B<br>B |
| | 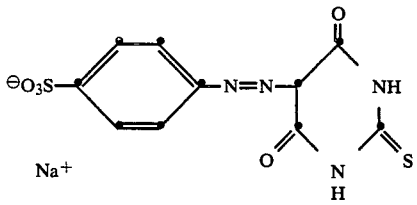 | | | |
| 94 | 3-Carboxymethyl-5-(2,6-dimethyl-4(H)—pyran-4-ylidene)rhodanine | None | cubic (5) | A |
| | 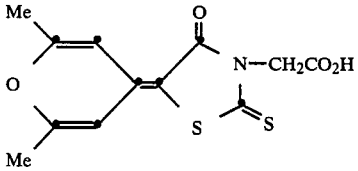 | | | |
| 95 | Anhydro-1,3'-bis(3-sulfopropyl)naphtho[1,2-d]-thiazolothiacyanine hydroxide, triethylamine salt | None | cubic (5) | A |

TABLE I-continued

| | Growth Modifier | {hkl} Surfaces | Host Grains | Method |
|---|---|---|---|---|
| | 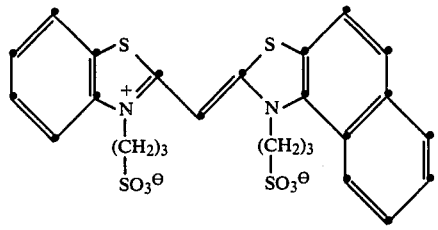 HNEt3+ | | | |
| 96 | 3-Ethyl-5-[3-(3-sulfopropyl)2-benzo-thiazolinylidene]rhodanine, triethylamine salt | None | cubic (5) | A |
| | 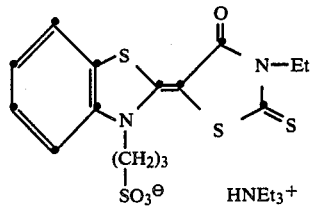 | | | |
| 97 | 3-Ethyl-5-[3-(3-sulfopropyl)2-benzo-oxazolinylidene]rhodanine, potassium salt | None<br>None | cubic<br>octahedral | B<br>B |
| | 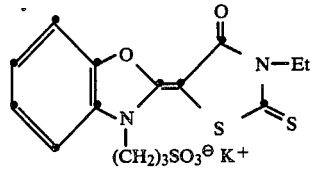 | | | |

(1) 3 mmoles of growth modifier/Ag mole of host grain emulsion was employed
(2) a pBr of 1.6 was employed
(3) 9 mmoles of growth modifier/Ag mole of host grain emulsion was employed, added in two portions
(4) 50° C. was employed instead of 60° C.
(5) 2 mmoles of growth modifier/Ag mole of host grain emulsion was employed
(6) 1.5 mmoles of growth modifier/Ag mole of host grain emulsion was employed
(7) 4 mmoles of growth modifier/Ag mole of host emulsion was employed
(8) a pBr of 2.3 was employed

COMPARATIVE EXAMPLE 6

The purpose of this comparative example is to report the result of adding 6-nitrobenzimidazole to a reaction vessel prior to the precipitation of silver bromide, as suggested by Wulff et al U.S. Pat. No. 1,696,830.

A reaction vessel equipped with a stirrer was charged with 0.75 g of deionized bone gelatin made up to 50 g with water. 6-Nitrobenzimdazole, 16.2 mg (0.3 weight % based on the Ag used), dissolved in 1 mL of methanol, was added, followed by 0.055 mole of KBr. At 70° C. 0.05 mole of a 2M solution of $AgNO_3$ was added at a uniform rate over a period of 25 min. The grains formed were relatively thick tablets showing {111} crystal faces. There was no indication of the novel hexoctahedral crystal faces of the invention.

COMPARATIVE EXAMPLE 7

The purpose of this comparative example is to report the result of employing 4-hydroxy-6-methyl-1,3,3a,7-tetraazaindene, sodium salt during grain precipitation, as suggested by Smith *Particle Growth and Suspension,* cited above.

To 100 ml of a 3% bone gelatin solution were added simultaneously 10 mL of 1.96M $AgNO_3$ and 10 mL of 1.96M KBr at 50° C. with stirring over a period of about 20 sec. The AgBr dispersion was aged for 1 min at 50° C., then diluted to 500 mL. The dispersion was adjusted to pBr 3 with KBr.

Samples 7a, 7b.

To 80 mL of 1×10—3M KBr containing 0.4 mmole/l of 4-hydroxy-6-methyl-1,3,3a,7-tetraazaindene, sodium salt and 0.6 mmole/l of 1-dodecylquinolinium bromide was added 20 mL of the above dispersion, which was then stirred at 23° C. Samples were removed after 15 min (Sample *7a) and* 60 min (Sample *7b).*

Samples *7c, 7d*

Samples *7c and 7d* were prepared similarly as Samples *7a* and *7b,* respectively, except that 0.8 mmole/l of 4-hydroxy-6-methyl-1,3,3a,7-tetraazaindene and 0.6 mmole/l of 1-dodecylquinolinium bromide were used.

Examination of the grains of each of the samples revealed rounded cubic grains. No hexoctahedral crystal faces were observed.

EXAMPLE 8

This example illustrates that a hexoctahedral emulsion exhibits an increase in photographic speed at a given fog level as compared to an octahedral emulsion of the same halide composition and grain volume.

EXAMPLE HEXOCTAHEDRAL EMULSION (A)

To a reaction vessel supplied with a stirrer was added 0.4 moles of an 0.7 μm AgIBr (6 mole percent I) octahedral emulsion containing ≈8 g bone gelatin/Ag mole. The contents of the kettle weighed 400 g. The emulsion was heated to 40° C., and 6.0 mmoles/Ag mole of 6-nitrobenzimidazole dissolved in 24 mL methanol was added. The mixture was held for 15 min at 40° C. The pH was adjusted to 6.0 at 60° C. and the pAg adjusted to 8.5 at 60° C. with NaBr solution, and maintained at these values during the precipitation. A 2.5M solution of $AgNO_3$ and a solution 2.48M in NaBr and 0.5M in NaI were then introduced with a constant silver addition rate over a period of 145 min, consuming 0.4 moles of Ag. The resulting emulsion was centrifuged and the solid silver halide phase was resuspended in 250 mL of 3% bone gelatin solution. Electron micrographs of this emulsion showed grains with distinct hexoctahedral crystal faces had been formed.

Control Emulsion (B)

This control emulsion was precipitated identically to the above hexoctahedral emulsion, except the 6-nitrobenzimidazole was added after the precipitation was complete, but before the centrifugation step. After this compound had been added, the emulsion was stirred for 15 min at 40° C., then centrifuged. The resulting grains were octahedral in shape.

Sensitization

Emulsions A and B were chemically sensitized, as listed below, and then coated on acetate support at 1.08 g Ag/m$^2$, 4.31 g bone gelatin/m$^2$, 0.81 g of a dispersion of the coupler 2-benzamido-5-[2-(4-butanesulfonylamidophenoxy)tetradecanamido]-4-chlorophenol/m$^2$, 0.14 g saponin/m$^2$ as spreading agent, and 18 mg bis(vinylsulfonylmethyl)ether/g gelatin as hardener.

| Coating | Emulsion |
|---|---|
| 1 | B heated 10 min at 70° C. with 2.4 mg/Ag mole sodium thiosulfate & 0.8 mg/Ag mole potassium chloroaurate |
| 2 | B heated 10 min at 70° C. with 4.8 mg/Ag mole sodium thiosulfate & 1.6 mg/Ag mole potassium chloroaurate |
| 3 | A heated 10 min at 70° C. with 2.4 mg/Ag mole sodium thiosulfate & 0.8 mg/Ag mole potassium chloroaurate |

These coatings were exposed for 0.1 s to a 2850° K. tungsten light source through a variable density tablet. These coatings were then processed for 1 min, 2 min, 3 min, 4 min, 5 min, 8 min in Kodak C-41 Color Negative developer at 38° C. The results are summarized below in Table II.

TABLE II

| Coating | Dev. Time (min.) | Fog | Log Relative Speed |
|---|---|---|---|
| 1 (Control) | 1 | 0.06 | 0.00 |
| | 2 | 0.07 | 0.19 |
| | 3 | 0.08 | 0.27 |
| | 4 | 0.11 | 0.41 |
| | 5 | 0.14 | 0.45 |
| | 8 | 0.18 | 0.64 |
| 2 (Control) | 1 | 0.07 | — |
| | 2 | 0.07 | 0.27 |
| | 3 | 0.07 | 0.53 |
| | 4 | 0.13 | 0.62 |

TABLE II-continued

| Coating | Dev. Time (min.) | Fog | Log Relative Speed |
|---|---|---|---|
| | 5 | 0.14 | 0.70 |
| | 8 | 0.20 | 0.92 |
| 3 (Example) | 1 | 0.07 | 0.91 |
| | 2 | 0.10 | 1.29 |
| | 3 | 0.19 | 1.38 |
| | 4 | 0.30 | 1.46 |
| | 5 | 0.39 | 1.49 |
| | 8 | 0.67 | 1.55 |

From Table II it is apparent that the example emulsion satisfying the requirements of this invention exhibits higher photographic speeds than the control octahedral emulsion. Further, this increased speed is realized even when the chemical sensitizers are doubled in concentration in the control emulsion. Whether compared at the same development times or at the same fog levels, the example emulsion of the invention is in all instances superior in photographic performance.

EXAMPLE 9

This example illustrates the selective site epitaxial deposition of a silver salt onto hexoctahedral grains of an emulsion satisfying the requirements of this invention.

To a reaction vessel supplied with a stirrer was added 0.05 moles of Emulsion A of Example 8. Distilled water was added to make a total contents weight of 50 g. The contents were heated to 40° C. and 0.92 mmole of NaCl was added. A 0.50M solution of $AgNO_3$ and a 0.52M solution of NaCl were then introduced with a constant silver addition rate over a period of 5 min, consuming 1.25 mmoles of silver. During the precipitation, the pAg was held constant at 7.5 and the temperature held constant at 40° C.

A 20,000X carbon replica electron micrograph of the resulting emulsion showed discrete epitaxial growths on the surfaces of the hexoctahedral host emulsion grains. The host grains showed some edge rounding after epitaxy.

The invention has been described in detail with particular reference to preferred embodiments thereof, but it will be understood that variations and modifications can be effected within the spirit and scope of the invention.

What is claimed is:

1. A silver halide photographic emulsion comprised of radiation sensitive silver halide grains of a cubic crystal lattice structure comprised of hexoctahedral crystal faces.

2. A silver halide photographic emulsion according to claim 1 wherein said silver halide grains comprised of hexoctahedral crystal faces are silver bromide grains.

3. A silver halide photographic emulsion according to claim 1 wherein said silver halide grains comprised of hexoctahedral crystal faces are silver chloride grains.

4. A silver halide photographic emulsion according to claim 1 wherein said silver halide grains comprised of hexoctahedral crystal faces contain at least one of bromide and chloride ions and optionally contain a minor proportion of iodide ions based on total silver.

5. A silver halide photographic emulsion according to claim 1 wherein said silver halide grains are additionally comprised of at least one of cubic and octahedral crystal faces.

6. A silver halide photographic emulsion according claim 1 wherein said silver halide grains are regular hexoctahedral grains.

7. A silver halide photographic emulsion according to claim 1 wherein a grain growth modifier is adsorbed to said hexoctahedral crystal faces.

8. A silver halide photographic emulsion according to claim 1 wherein said hexoctahedral crystal faces satisfy the Miller index assignment {hkl, wherein h, k, and l are integers greater than 0, h is greater than k, k is greater than l, and h is 5 or less.

9. A silver halide photographic emulsion according to claim 8 wherein said hexoctahedral crystal faces exhibit a {321} or {521} Miller index.

10. A silver halide photographic emulsion according to claim 9 wherein a grain growth modifier is present in said emulsion chosen from the class consisting of 6-nitrobenzimidazole, 5-nitro-o-phenyleneguanidine nitrate, 5-carbethoxy-4-hydroxy-1,3,3a,7-tetraazaindene, and 3-carboxymethyl-5-{[3-(3-sulfopropyl)-2-thiazolidinylidene]ethylidene}rhodanine, sodium salt.

11. A photographic element containing an emulsion according to claim 1.

* * * * *